US005547018A

United States Patent [19]

Takahashi et al.

[11] Patent Number: 5,547,018

[45] Date of Patent: Aug. 20, 1996

[54] AIR CONDITIONER

[75] Inventors: Tomomi Takahashi; Masahisa Takata; Masayoshi Kogure; Ritsushi Taira; Hiroyuki Hamano, all of Kawasaki, Japan

[73] Assignee: Fujitsu General Limited, Kawasaki, Japan

[21] Appl. No.: 351,590

[22] Filed: Dec. 7, 1994

[30] Foreign Application Priority Data

Dec. 10, 1993 [JP] Japan ..... 5-310088
Nov. 10, 1994 [JP] Japan ..... 6-301407

[51] Int. Cl.[6] ..... F28F 13/12; F28F 27/00

[52] U.S. Cl. ..... 165/267; 165/96; 165/122; 236/49.3; 454/258

[58] Field of Search ..... 165/122, 96, 40, 165/12; 236/49.3; 454/258

[56] References Cited

U.S. PATENT DOCUMENTS 4,615,481 10/1986 Tanaami et al. ..... 165/40 X
4,807,444 2/1989 Aoki et al. ..... 236/49.3 X

FOREIGN PATENT DOCUMENTS 112627 7/1982 Japan ..... 165/122
74445 4/1984 Japan ..... 454/258
74446 4/1984 Japan ..... 454/258
114660 5/1989 Japan ..... 454/258
356629 12/1992 Japan ..... 454/258
203223 8/1993 Japan ..... 454/258

*Primary Examiner*—Leonard R. Leo
*Attorney, Agent, or Firm*—Kanesaka & Takeuchi

[57] ABSTRACT

An air conditioner includes a housing to be mounted on a wall surface in the interior of a room, an air inlet provided at an upper part of the housing, an air outlet provided at a lower part of the housing, an air passage provided in said housing so as to connect the air inlet and said air outlet to each other, a heat exchanging means and an air blowing device disposed in said air passage, and a wind direction plate provided inside an opening of the air outlet in order to change the direction of blowing of thermoregulated air out of the air outlet. An air quantity adjusting plate is provided at an end of the opening of said air outlet in order to change the area of the opening of the air outlet, whereby a sufficient air quantity is obtained regardless of the direction of ventilation of thermoregulated air to thereby perform room air-conditioning efficiently.

19 Claims, 14 Drawing Sheets

AIR CONDITIONER

BACKGROUND OF THE INVENTION

1. Field of the Invention

The present invention relates to an air conditioner and more particularly to an air conditioner for performing room air-conditioning efficiently irrespective of the direction of blowing of thermoregulated air.

2. Description of the Related Art

It is general that an air conditioner set up for a structure or building such as a house, or the like, is constituted by an interior equipment set up in the interior of the structure, that is, indoors, and an exterior equipment set up in the exterior of the structure.

FIG. 13 shows an interior equipment 91 constituting an air conditioner 90. The interior equipment 91 has a housing 92 shaped substantially like a rectangular parallelepiped so as to extend in the direction of the depth in the drawing. The housing 92 is mounted on a wall surface 93 in the interior of a room. The interior equipment 91 is mounted on a position near a ceiling 94 in order to make efficient use of the interior space.

The interior equipment 91 premised on the aforementioned setting-up form employs a structure in which interior air can be sucked in from the upper part of the housing 92 and blown out into the room from the lower part of the housing 92 in order to perform room air-conditioning efficiently.

Specifically, the housing 92 of the interior equipment 91 has an air inlet 95 provided at the upper part thereof, and an air outlet 96 provided at the lower front surface (opposite to the wall surface 93) thereof.

The air inlet 95 and the air outlet 96 are connected to each other through an air passage 97 provided in the housing 92 so that air having flown in through the air inlet 95 flows out through the air outlet 96. A heat exchanger 98 which is a heat exchanging means and a cross flow fan 99 which is an air blowing means are disposed in the air passage 97. A blowout passage 97A curved from just under the cross flow fan 99 toward the air outlet 96 is formed in the downstream side of the air passage 97.

The air outlet 96 is provided with a wind direction plate 101 for changing the direction of blowing of thermoregulated air such as cooled air, heated air, or the like, to be blown out to an opening portion 100 through the air outlet 96.

As shown in FIG. 14, the wind direction plate 101 is shaped substantially like a belt continuing along the direction of the longitudinal length (the direction perpendicular to the paper in the drawing) of the housing 92 and is made rotatable around a pivot 102 which is provided in the housing 92 so as to be parallel with the wall surface 93. The range of rotation of the wind direction plate 101 is set to be from a position (forward ventilation position) indicated by the two-dot-and-dash line A in the drawing to a position (downward ventilation position) indicated by the two-dot-and-dash line B in the drawing.

Returning to FIG. 13, in the aforementioned interior equipment 91, interior air is sucked into the air passage 97 through the air inlet 95 by the cross flow fan 99, cooled or heated by the heat exchanger 98 and thermoregulated to a predetermined temperature. The thus thermoregulated air is sent out to the air outlet 96 through the blowout passage 97A and blown out as cooled or heated air toward the interior of a room.

Returning to FIG. 14 again, when the air conditioner 90 is in air-cooling operation, cooled air is blown out in the direction of the arrow C in the drawing with the wind direction plate 101 rotated to the forward ventilation position. When the air conditioner 90 is in air-heating operation contrariwise, heated air is blown out to the obliquely downward direction of the arrow D in the drawing with the wind direction plate 101 rotated to the obliquely downward ventilation position.

Incidentally, when the air conditioner 90 is out of operation, the wind direction plate 101 is used to serve as a cover for substantially shutting an opening portion 100 of the air outlet 96 by rotating the wind direction plate 101 to a position (not shown) in which the surface of the wind direction plate 101 is contiguous to the outer surface of the housing 92.

Hereupon, in the case where thermoregulated air in the aforementioned air conditioner 90 is to be blown out of the air outlet 96 in the vertically downward direction of the arrow E in the drawing, it is necessary to rotate the wind direction plate 101 to a position (vertically downward ventilation position) indicated by the solid line F in the drawing.

The aforementioned air conditioner 90 however has a problem that air-conditioning efficiency is poor in the case of vertically downward ventilation of thermoregulated air, when it is compared with the case of forward ventilation and obliquely downward ventilation of thermoregulated air.

That is, the shape of the opening of the air outlet 96 seen from the front of the air conditioner 90 (when viewed so as to face the wall surface 93) is made to be a substantially rectangular parallelepiped shape which is long laterally. The short side size of the substantial area of the opening in the case where the wind direction plate 101 is rotated to the forward ventilation position and the short side size of the substantial area of the opening in the case where the wind direction plate 101 is rotated to the obliquely downward ventilation position are G and H, respectively, whereas the short side size of the substantial area of the opening in the case where the wind direction plate 101 is rotated to the vertically downward ventilation position is I which is shorter than the aforementioned sizes G and H.

In other words, because the substantial area of the opening of the air outlet 96 in the case where thermoregulated air is blown vertically downward is narrowed when it is compared with the case where thermoregulated air is blown forward or obliquely downward, a sufficient air quantity cannot be obtained, so that there arises a problem that air-conditioning efficiency becomes poor.

Further, the blowout passage 97A formed in the downstream side of the air passage 97 is shaped so that blown air resistance is minimized when thermoregulated air is blown forward or obliquely downward.

When the wind direction plate 101 is rotated to the vertically downward ventilation position in order to blow thermoregulated air vertically downward, the wind direction plate 101 however constitutes resistance in the blowout passage 97A, so that there arises a problem that a sufficient air quantity cannot be obtained from this point of view.

Incidentally, according to Japanese Patent Publication No. 47165/1991, there is shown an air conditioner in which blowout wind speed is kept higher than a certain range by an area changing member for changing the area of the air outlet (conventional example 1). On the other hand, according to Japanese Patent Unexamined Publication No. 160252/1989, there is shown an air conditioner having a wind direction adjusting plate (wind direction plate), and a shielding plate for shielding the air outlet, in which the shielding plate is stored in a storage portion when the air conditioner is operated (conventional example 2).

The conventional example 1 is however designed so that when the quantity of air blown from a fan is reduced, the area changing member is pressed out into the blowout passage to reduce the area of the opening of the air outlet so that the speed of wind (speed of air) blown out through the air outlet is kept higher than a predetermined value by so-called venturi effect.

That is, the conventional example 1 aims at avoiding the lowering of the wind speed regardless of the reduction of the quantity of air blown from the fan but does not aim at obtaining a sufficient wind quantity (air quantity) regardless of the direction of blowing of air sent out from the air outlet. Accordingly, the conventional example 1 does not serve as a measure to solve the aforementioned problem.

On the other hand, the conventional example 2 also aims at opening/shutting the air outlet through the shielding plate in accordance with the operation/stop of the air conditioner. That is, because the shielding plate in the conventional example 2 is stored in the storage portion while the air conditioner is in operation, the shielding plate has no specific function. Accordingly, the conventional example 2 does not serve as a measure to solve the aforementioned problem.

The aforementioned problem arises similarly not only in the case where the interior equipment constituting the air conditioner is mounted on a wall surface in the interior of a room but also in the case where the interior equipment is set up on the floor in the interior of a room or embedded in the ceiling in the interior of a room, because the shape of the blowout passage is constant.

Further, this problem arises similarly not only in the air conditioner of the type in which the interior equipment and the exterior equipment are set up separately in the interior and exterior of a building but-also in the so-called integrated type air conditioner in which the interior equipment and the exterior equipment are put into the one and the same housing so that the housing is, for example, mounted on a window sash.

SUMMARY OF THE INVENTION

The present invention is provided to solve the aforementioned problem in the conventional case and an object of the present invention is to provide an air conditioner in which a sufficient air quantity is obtained regardless of the direction of blowing of thermoregulated air especially even in the case where thermoregulated air is blown vertically downward, so that air-conditioning is performed efficiently.

The present invention is based on the fact that the area of the opening of the air outlet can be kept constant regardless of the direction of the wind direction plate when, for example, the wind direction plate is rotated to the vertically downward ventilation position to narrow the area of the opening of the air outlet, as long as a suitable member for widening the substantial area of the opening of the air outlet is provided at an opening end of the opening portion in advance.

To achieve the foregoing object, according to an aspect of the present invention, provided is an air conditioner having a housing to be mounted on a wall surface in the interior of a room, an air inlet provided at an upper part of the housing, an air outlet provided at a lower part of the housing, an air passage provided in the housing so as to connect the air inlet and the air outlet to each other, a heat exchanging means and an air blowing means disposed in the air passage, and a wind direction plate provided inside an opening of the air outlet in order to change the direction of blowing of thermoregulated air to be blown out of the air outlet, wherein an air quantity adjusting plate is provided at an end of the opening of the air outlet in order to change the area of the opening of the air outlet.

In this case, when, for example, the shape of the opening of the air outlet is a substantially rectangular parallelepiped shape, the air quantity adjusting plate may be shaped substantially like a belt or the like and may be provided along a long side end of the opening of the air outlet.

Further, the air quantity adjusting plate may be provided so as to be rotatable around a pivot provided in the housing or may be provided so as to be attachable to and detachable from the housing or may be provided so as to be able to be stored in the inside of the housing by sliding, winding or the like.

Preferably, the air quantity adjusting plate has a first face being contiguous to an inner wall of the opening of the air outlet, and a second face being contiguous to an outer surface of the housing.

In this case, for example, the first face may be contiguous to the inner wall of the blowout passage so as to be even in surface and the second face may be contiguous to the decoration cover so as to be in surface.

Preferably, the air quantity adjusting plate has a substantially V-shaped section in which the first and second faces are connected to each other.

Preferably, the air quantity adjusting plate is made rotatable around a pivot provided in the housing.

For connection of the pivot and the air quantity adjusting plate to each other, when, for example, the air quantity adjusting plate is shaped substantially like a belt, the pivot may be connected along the long side end portion of the air quantity adjusting plate or may be connected so as to be placed on the surface of the air quantity adjusting plate. Further, in the case where the air quantity adjusting plate is constituted by the first face and the second face, the form of connection between the air quantity adjusting plate and the pivot can be applied to the first face.

Preferably, the pivot is provided so as to be parallel with a wind direction plate pivot which supports the wind direction plate pivotally.

Preferably, the pivot is provided at a boundary portion between the inner wall of the opening of the air outlet and the first face. The pivot may be provided in the rear side of the boundary portion.

Preferably, the air quantity adjusting plate is made rotatable in a range of from an initial position in which the first face is contiguous to the inner wall of the opening of the air outlet and in which the area of the opening of the air outlet is minimized to an open position in which the area of the opening of the air outlet is maximized.

Preferably, the air quantity adjusting plate has its rear surface onto which a heat insulating material is stuck, and preferably, the heat insulating material is stuck onto a rear surface of the first face.

For example, felt, glass wool, or the like, may be employed as the heat insulating material, and the heat insulating material may be stuck to a predetermined position by an adhesive agent or the like.

Preferably, the air quantity adjusting plate is shaped so that an outer surface side end portion of the housing at the second face does not interfere with the outer surface of the housing when the air quantity adjusting plate is rotated to the open position. For example, a position interfering with the outer surface of the housing in the second face may be formed so as to be shorter in advance.

Preferably, the air quantity adjusting plate has a chamfered portion provided in its surface at a junction portion between the first and second faces.

As for the air quantity adjusting plate in this case, a flat surface or a circular arc surface may be formed in advance along the junction ridgeline between the first and second faces.

Preferably, a step portion is provided at an outer surface of the housing adjacent to the second face.

As for the step portion, for example, an end portion of the decoration cover may be formed to be substantially Z-shaped, U-shaped, or the like, in section.

Preferably, the air quantity adjusting plate is rotated by a driving means.

Preferably, the driving means is constituted by an electric motor. Driving means may be constituted by a solenoid valve.

Preferably, the driving means is controlled by a control means.

The control means may be designed to control the timing of rotating the air quantity adjusting plate, the starting/stopping of the driving means, and so on.

Preferably, the wind direction plate and the air quantity adjusting plate are controlled synchronously with each other by the control means, and preferably, the air quantity adjusting plate is rotated to the open position when the wind direction plate is turned downward most extremely.

Preferably, the air quantity adjusting plate is rotated to the open position when a predetermined time has passed after starting of operation of the air conditioner, and preferably, the air quantity adjusting plate is rotated to the open position when a temperature of the heat exchanging means has reached a predetermined value after starting of operation of the air conditioner. Further preferably, the air quantity adjusting plate is rotated to the open position when a room temperature has reached a predetermined value after starting of operation of the air conditioner.

According to the present invention, because the air quantity adjusting plate is provided at an end of the opening of the air outlet as described above, the substantial area of the opening of the air outlet can be widened as long as, for example, the air quantity adjusting plate is rotated or stored in the inside of the housing when the reduction of the area of the opening of the air outlet is caused by the rotation of the wind direction plate to the vertically downward ventilation position as in the conventional case. Accordingly, it is possible to solve the problem that air-conditioning efficiency is lowered as in the conventional case when thermoregulated air is blown out in a specific direction.

Further, according to the present invention, as described above, the air quantity adjusting plate has a first face contiguous to the inner wall of the opening of the air outlet, and a second face contiguous to the outer surface of the housing. Accordingly, if the air quantity adjusting plate is disposed so that the first and second faces are contiguous to the inner wall of the opening of the air outlet and to the outer surface of the housing, respectively, the air quantity adjusting plate is provided inconspicuously ordinarily, so that external appearance of the housing can be made good.

Further, according to the present invention, the section of the air quantity adjusting plate is to be substantially V-shaped as described above. Accordingly, even in the case where a blowout passage curved as in the conventional case is formed in the downstream side of the air passage, the continuity to the inner wall of the opening of the air outlet and the continuity to the outer surface of the housing are obtained simultaneously.

Further, according to the present invention, the air quantity adjusting plate can be rotated around the pivot as described above. Accordingly, in the case where the area of the opening of the air outlet is to be changed, the troublesome work of removing the air quantity adjusting plate from the housing and the necessity of forming a storage portion or the like in the inside of the housing in advance in order to store the air quantity adjusting plate in the storage portion can be avoided.

Further, according to the present invention, the pivot is parallel with the wind direction plate pivot, so that the air quantity adjusting plate can be rotated in the same direction as the wind direction plate as described above. Accordingly, as long as the air quantity adjusting plate and the wind direction plate are disposed so as to be parallel with each other, the reduced area of the opening of the air outlet by the wind direction plate can be widened easily by the ration of the air quantity adjusting plate in the same direction as the wind direction plate.

Next, according to the present invention, the pivot is provided at a boundary portion between the inner wall of the opening of the air outlet and the first face, so that the end portion of the first face does not project into the opening of the air outlet regardless of the rotation of the air quantity adjusting plate as described above. Accordingly, blown air resistance in the inside of the opening of the air outlet is not increased even in the case where the air quantity adjusting plate is rotated.

Further, according to the present invention, the air quantity adjusting plate can be rotated/returned unidirectionally in the case where the air quantity adjusting plate is to be rotated from the initial position to the open position or in the case where the air quantity adjusting plate is to be returned from the open position to the initial position as described above. Accordingly, when, for example, the air quantity adjusting plate is to be rotated by using a suitable driving means, forward/backward rotation of the driving means can be repeated in a predetermined range of rotation.

Further, according to the present invention, the heat insulating material such as felt, glass wool, or the like, is stuck to the rear surface of the air quantity adjusting plate as described above, so that dew condensation, or the like, can be prevented from occurring in the front surface of the air quantity adjusting plate when cooled air is blown out.

Further, according to the present invention, the heat insulating material is stuck to the rear surface of the first face having the highest risk of dew condensation also in the case where the air quantity adjusting plate has the first face and the second face as described above. Accordingly, dew condensation as described above can be prevented securely.

Next, according to the present invention, for example, the second face is formed so as to be sufficiently short in advance so that the second face does not interfere with the outer surface of the housing when the air quantity adjusting plate is rotated as described above. Accordingly, the range of rotation of the air quantity adjusting plate from the initial position to the open position can be widened.

Further, according to the present invention, a chamfered portion is provided between the first and second faces as described above, so that not only the short side size of the substantial area of the opening can be increased but also blown air resistance can be reduced in the case where the air quantity adjusting plate is rotated to the open position.

Further, according to the present invention, a step portion is provided in the outer surface of the housing, so that the second face of the air quantity adjusting plate and the outer surface of the housing do not interfere with each other as described above. Accordingly, the range of rotation of the air quantity adjusting plate can be widened more greatly.

Further, according to the present invention, the air quantity adjusting plate is rotated by a driving means as described above, so that the rotating operation of the air quantity adjusting plate can be performed without depending on an operator.

Further, according to the present invention, if an electric motor or a solenoid valve is used as the driving means as described above, increase of production cost can be reduced by using general-use parts even in the case where the air quantity adjusting plate is provided in the air conditioner newly.

Further, according to the present invention, the driving means is controlled by a control means such as a CPU, or the like as described above, so that the rotating operation of the air quantity adjusting plate can be automated as long as a predetermined condition is set suitably.

Next, according to the present invention, the wind direction plate and the air quantity adjusting plate are controlled synchronously with each other by the control means as described above, so that the air quantity adjusting plate can be rotated in synchronism with the ventilation position of the wind direction plate.

In addition, according to the present invention, the air quantity adjusting plate is rotated to the open position when, for example, the wind direction plate in the vertically downward ventilation position, or the like, is turned most extremely downward as described above. Further according to the present invention, the air quantity adjusting plate is rotated to the open position after a predetermined time has passed as described above. Further according to the present invention, the air quantity adjusting plate is rotated to the open position when the temperature of the heat exchanging means has reached a predetermined temperature as described above. Still further according to the present invention, the air quantity adjusting plate is rotated to the open position when the room temperature has reached a predetermined temperature as described above. In the air conditioner, accordingly, it is possible to control the air quantity adjusting plate under various kinds of conditions to thereby achieve the foregoing object.

DETAILED DESCRIPTION OF THE PREFERRED EMBODIMENTS

Embodiments of the present invention will be described below with reference to the drawings.

Figure 1:
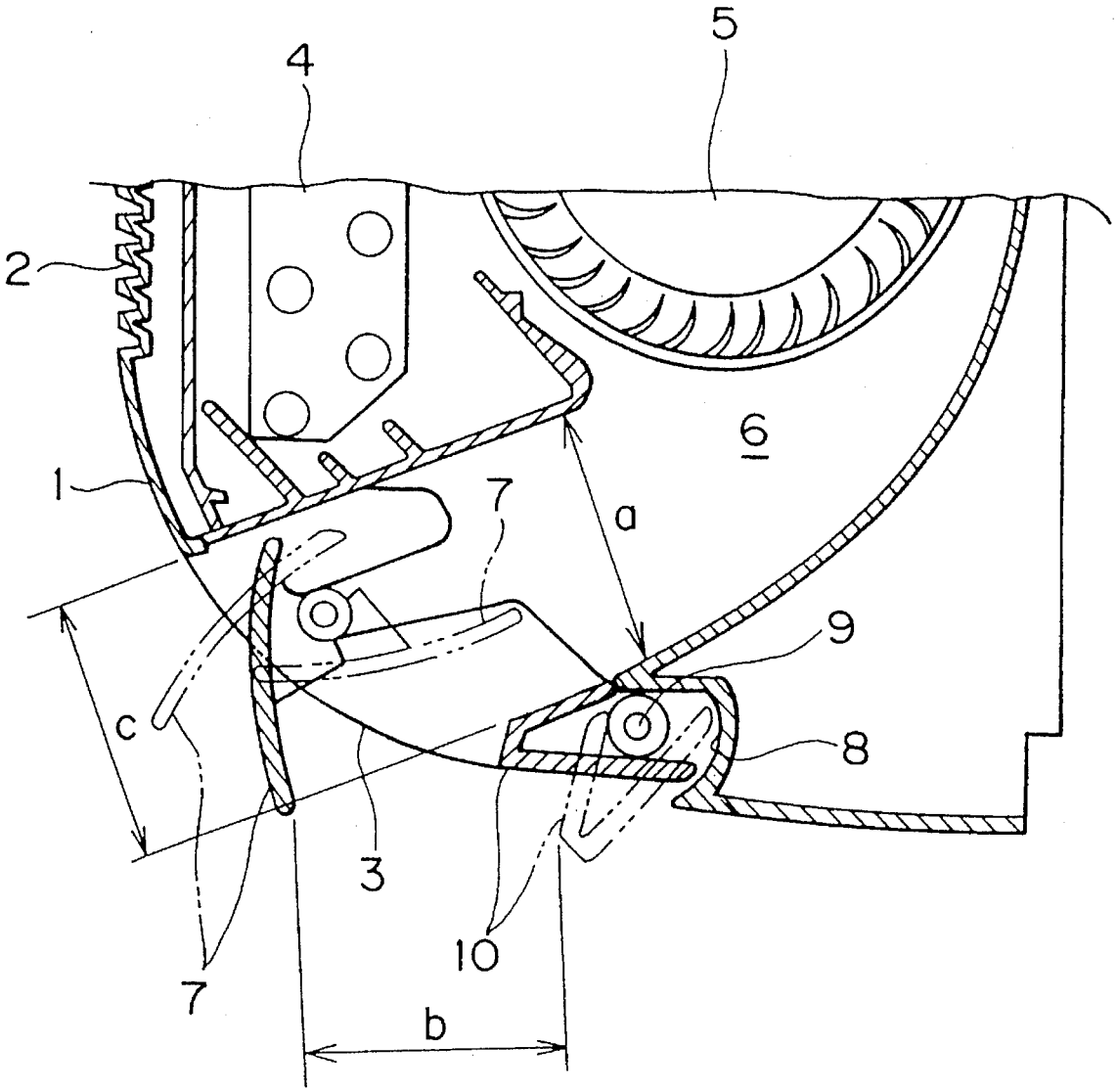
FIG. 1 is an important part sectional view showing a first embodiment of the present invention.
Figure 2:
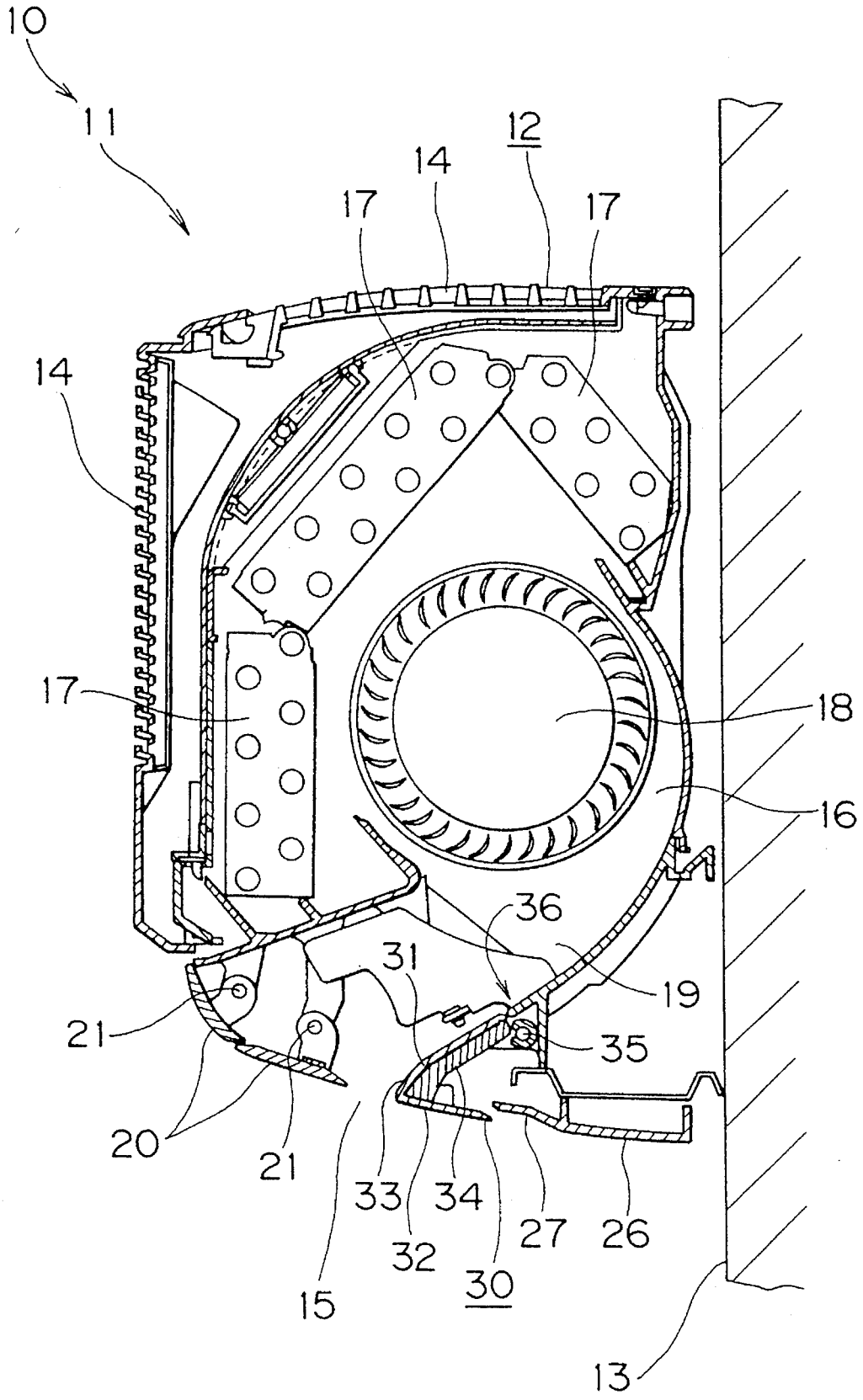
FIG. 2 is an overall sectional view showing a second embodiment of the present invention.

FIG. 1 shows a first embodiment of the present invention. As shown in the drawing, a heat exchanger 4 and a cross flow fan 5 are disposed in an air passage which connects an air inlet 2 and an air outlet 3 to each other in a housing 1. A wind direction plate 7 for changing the direction of blowing of air between forward and downward directions is provided so as to be rotatable about a shaft. The wind direction plate 7 is provided with a driver (not shown) at one end of the above-mentioned shaft.

A blowout passage 6 is provided so as to extend from the cross fan 5 to the air outlet 3. A movable plate 10 integrally formed with a rotation shaft 9 is provided in a recess 8 formed at an end of the lower portion of the blowout passage 6. The movable plate 10 is made rotatable with the rotation shaft 9 from a regular position indicated by the solid line in the drawing to a rotation position indicated by the two-dotted chain line in the drawing.

This movable plate 10 is rotated to the rotation position when the wind direction plate 7 is in a position indicated by the solid line in the drawing so that the distance b between the wind direction plate 7 and the movable plate 10 is made equal to or larger than the distance a between the upper and lower portions of the blowout passage 6, that is, the condition $b \geqq a$ is established.

The movable plate 10 is located in the regular position when the wind direction plate 7 is in a position indicated by the two-dotted chain line in the drawing so that the distance c between the forward upper portion of the blowout passage 6 and the movable plate 10 is made equal to or larger than the distance a between the upper and lower portions of the blowout passage 6, that is, the condition $c \geqq a$ is established.

The movable plate 10 is arranged so that the upper surface of the movable plate 10 and the lower surface of the blowout passage 6 become even to each other when the movable plate 10 is in the regular position so that the real width of the air outlet 3 does not become narrow. The rotation shaft 9 is provided with driver means at its one end portion and mounted on the inner surface of the housing 1.

The driver means of the movable plate 10 is suitably controlled by a controller (not shown) so that the movable plate 10 and the wind direction plate 7 rotate in synchronism with each other. Consequently, when the wind direction plate 7 is rotated to the position indicated by the solid line in the drawing, the movable plate 10 is automatically rotated to the rotation position so that the above distance a and the above distance b can always hold the relation b≧a. On the hand, when the wind direction plate 7 is rotated to the position indicated by the two-dotted chain line in the drawing, the movable plate 10 is automatically located in the regular position so that the above distance a and the above distance c can always hold the relation c≧a.

According to this embodiment, since the movable plate 10 is provided in the recess 8 formed at an end of the lower portion of the blowout passage 6, high efficiency can be maintained without any increase of air resistance in the blowout passage 6 if the movable plate 10 is suitably rotated.

Further, the driver of the movable 10 is controlled so that the wind direction plate 7 and the movable plate 10 rotate in synchronism with each other. That is, since the movable plate 10 rotates in synchronism with the wind direction plate 7 automatically, it is not necessary to perform separate operation to change the direction of the movable plate 10 so that high air sending efficiency can be always maintained.

FIGS. 2 to 6 show a second embodiment of the present invention. In this embodiment, the air conditioner 10 is constituted by an interior equipment 11 set up in the interior of a structure or building and an exterior equipment (not shown) set up in the exterior of the structure or building.

The interior equipment 11 has a housing 12 substantially shaped like a rectangular parallelepiped and is mounted on a wall surface 13 constituting the interior of a room so that the direction of the longitudinal thereof extends horizontally. In the interior equipment 11, an air inlet 14 for sucking in air from the room and an air outlet 15 for blowing out cooled air or heated air into the room are provided at the upper portion of the housing 12 and at the lower portion of the housing 12, respectively, in order to perform room air-conditioning efficiently.

Specifically, the air inlet 14 is provided in the substantially whole region of the upper surface (upper side surface in the drawing) of the housing 12 and in the upper half of the front surface (left side surface in the drawing) of the housing 12. On the other hand, the air outlet 15 is provided in the obliquely lower portion of the front surface of the housing 12 and has an opening shaped substantially like a rectangular parallelepiped so as to be extend in parallel with the direction of the longitudinal of the housing 12.

Further, the air inlet 14 and the air outlet 15 are connected to each other through an air passage 16 provided in the inside of the housing 12.

The air passage 16 is provided so that interior air passes through the air inlet 14, the air passage 16 and the air outlet 15 successively and goes out into the room. Internal parts including a plurality of heat exchangers 17 as heat exchanging means and a cross flow fan 18 as an air blowing means are disposed in the middle of the air passage 16. As shown in the drawings, the heat exchangers 17 are disposed in the form of an inverted-V shape in section so as to surround the cross flow fan 18 so that air sucked into the air passage 16 from the room through the air inlet 14 is subjected to heat exchange efficiently.

A blowout passage 19 is provided in the downstream side of the air passage 16. The blowout passage 19 is formed so as to be curved from just under the cross flow fan 18 toward the air outlet 15 and so as to be widened toward the air outlet 15.

The blowout passage 19 is provided so that thermoregulated air obtained by the heat exchangers 17 for cooling or heating air passing through the air passage 16 is guided toward the air outlet 15. The blowout passage 19 is therefore shaped so that blown air resistance is reduced as greatly as possible.

Further, a pair of wind direction plates 20 is provided in the opening of the air outlet 15 in order to change the direction of blowing of air at the time of blowing of the thermoregulated air as cooled or heated air into the room.

Each of the wind direction plates 20 is substantially shaped like a belt so as to extend in the direction of the longitudinal of the opening shape (substantially rectangular parallelepiped shape) of the air outlet 15 and the wind direction plates 20 are pivotally supported by wind direction plate pivots 21 provided in the opening of the air outlet 15. The wind direction plate pivots 21 are disposed in pair so that the axes thereof are parallel with the direction of the length of the opening shape of the air outlet 15, that is, parallel with a wall surface 13 of the interior of the room. Further, the wind direction plates 20 are pivotally supported by the wind direction plate pivots 21 respectively so that the wind direction plates 20 can be rotated counterclockwise in the drawings individually.

Figure 3:
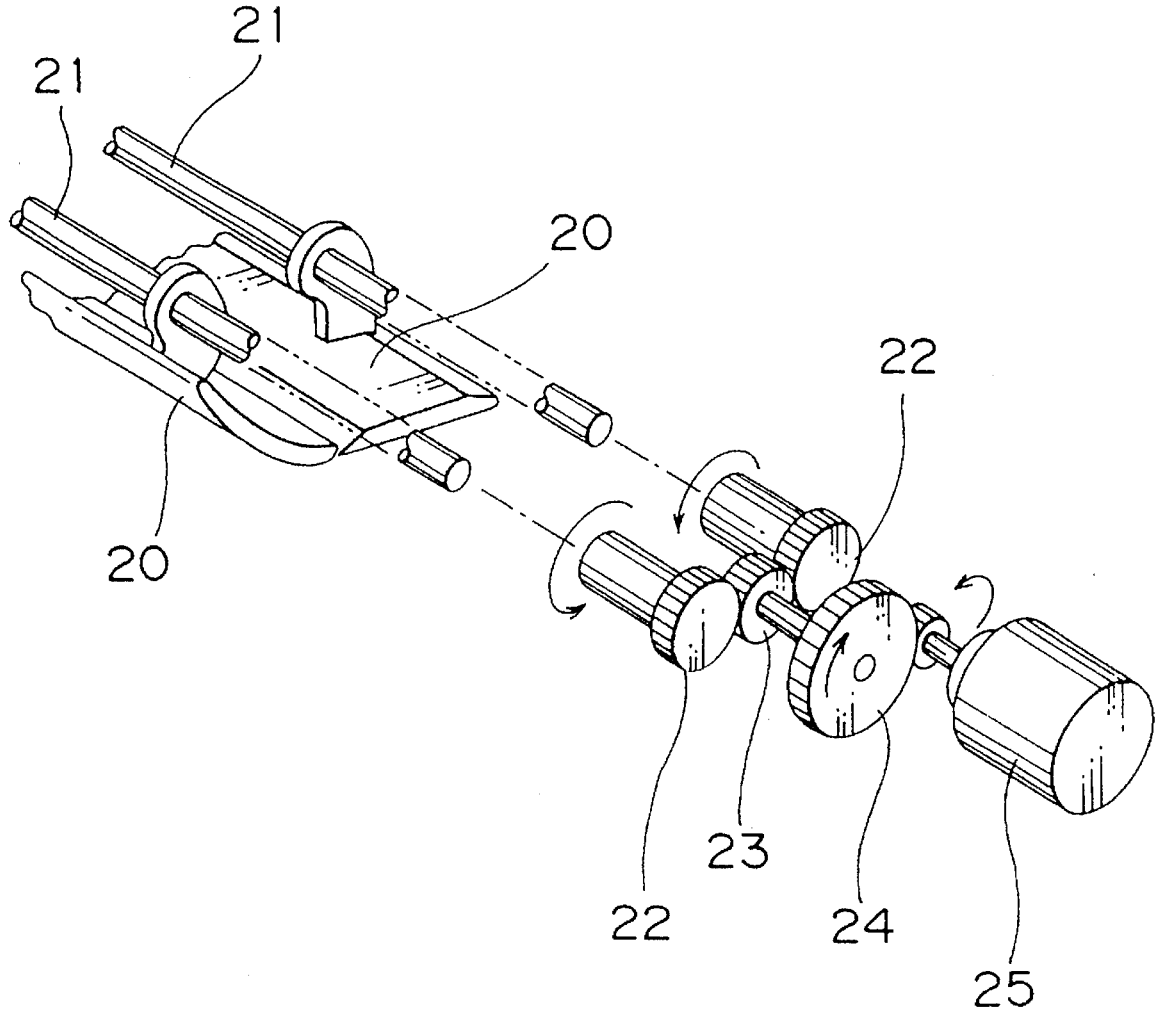
FIG. 3 is an important part sectional view showing an important part of the aforementioned embodiment.

As shown in FIG. 3, driving gears 22 are mounted on end portions of the wind direction plate pivots 21, respectively. Rotational power of a wind direction plate driving motor 25 which is a wind direction plate driving means is transmitted to these driving gears 22 through speed-reduction gears 23 and 24.

Accordingly, when the wind direction plate driving motor 25 is started, each of the gears is rotated by a predetermined angle in the direction indicated by the arrow in the drawing so that the wind direction plates 20 can be rotated around the wind direction plate pivots 21 in the same direction simultaneously.

The rotation angle of the aforementioned wind direction plate driving motor 25 is controlled in accordance with the range of the rotation of each of the wind direction plates 20 by a control means not shown. Specifically, when thermoregulated air is to be blown vertically downward from the air outlet 15, the wind direction plates 20 are rotated to vertically downward ventilation positions in which thermoregulated air is blown most extremely downward as indicated by the two-dot-and-dash line in FIG. 4, by the wind direction plate driving motor controlled by the control means.

Figure 4:
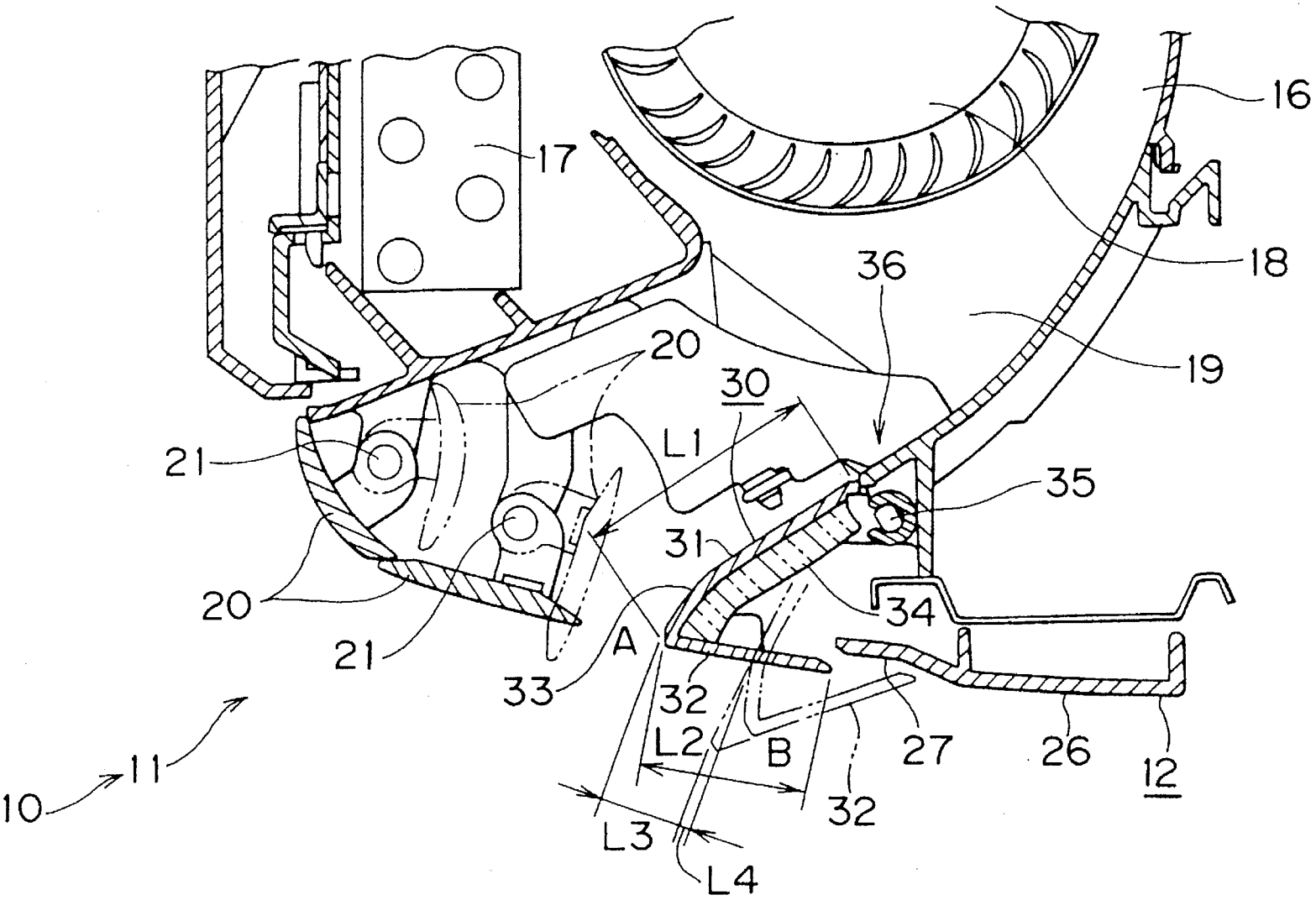
FIG. 4 is a typical perspective view showing the driving means in the aforementioned embodiment.

As shown in FIG. 4, an air quantity adjusting plate 30 for changing the area of the opening of the air outlet 15 is provided at the long side end of the opening of the substantially rectangular parallelepiped air outlet 15.

The air quantity adjusting plate 30 has a first face 31 shaped substantially like a belt contiguous to the blowout passage 19 which is an inner wall of the opening of the air outlet 15, and a second face 32 shaped substantially like a belt contiguous to a decoration cover 26 covering the outer surface of the housing 12. The air quantity adjusting plate 30 is provided so as to be rotatable in a range of from an initial position A indicated by the solid line in FIG. 4 to an open position B indicated by the two-dot-and-dash line in FIG. 4.

Hereupon, in the initial position A of the air quantity adjusting plate 30, the first face 31 and the blowout passage 19 are contiguous to each other so that the area of the opening of the air outlet 15 is minimized. On the other hand, in the open position B of the air quantity adjusting plate 30, the area of the opening of the air outlet 15 is maximized.

Accordingly, when the air quantity adjusting plate 30 is rotated from the initial position A to the open position B, the short side size of the area of the opening of the air outlet 15 is increased by a length L3 so that the area of the opening is widened.

The first face 31 and the second face 32 are connected to each other so that the first face 31 and the second face 32 in the air quantity adjusting plate 30 are integrated to be substantially V-shaped in section.

With respect to the sectional shape, the sectional length L2 of the second face 32 is set to be shorter than the sectional length L1 of the first face 31. Accordingly, an end portion of the second face 32 and the decoration cover 26 do not interfere with each other even in the case where the air quantity adjusting plate 30 is rotated to the open position B.

On the other hand, an end position of the second face 32 and an end position of the decoration cover 26 are arranged so that the distance therebetween is reduced. Further, a step portion 27 directed to the inside of the housing 12 is formed at the end position of the decoration cover 26 so that the end position of the second face 32 and the end portion of the decoration cover 26 are also prevented from interfering with each other even in the case where the air quantity adjusting plate 30 is rotated to the open position B.

A chamfered portion 33 is provided at the surface of a junction portion between the first and second faces 31 and 32. The chamfered portion 33 is formed in a range of from the junction ridgeline between the first and second faces 31 and 32 to the first face 31.

Accordingly, when it is compared with the case where the chamfered portion 33 is not provided (three-dot-and-dash line in FIG. 4), the air quantity adjusting plate 30 is designed so that the short side size of the substantial area of the opening of the air outlet 15 can be increased by a length L4 when the air quantity adjusting plate 30 is located in the open position B as indicated by the two-dot-and-dash line in the drawing.

Further, a heat insulating material 34 is stuck to the rear surface of the first face 31, that is, in a position not exposed to the outside in the air quantity adjusting plate 30. The heat insulating material 34 is selected from felt, glass wool, and so on, having heat insulating property. The heat insulating material 34 is stuck to the rear surface of the first face 31 by an adhesive agent. Accordingly, even in the case where cooled air passes along the front surface of the first face 31, there is no dew condensation caused by the temperature difference between the front and rear surfaces of the first face 31. Furthermore, there is no impediment to external appearance because the heat insulating material 34 is not exposed to the outside.

The aforementioned air quantity adjusting plate 30 is pivotally supported by a pivot 35 provided in the housing 12 so that the air quantity adjusting plate 30 can be rotated in a range of from the initial position A to the open position B.

The pivot 35 is provided in the rear side of a boundary portion 36 between the first face 31 and the blowout passage 19 so as to be parallel with the wind direction plate pivots 21. Accordingly, because the air quantity adjusting plate 30 can be rotated around the pivot 35 in the same direction as the direction of the rotation of the wind direction plates 20 and because the pivot 35 does not project into the blowout passage 19, the air quantity adjusting plate 30 does not constitute air resistance against ventilation of thermoregulated air.

Figure 5:
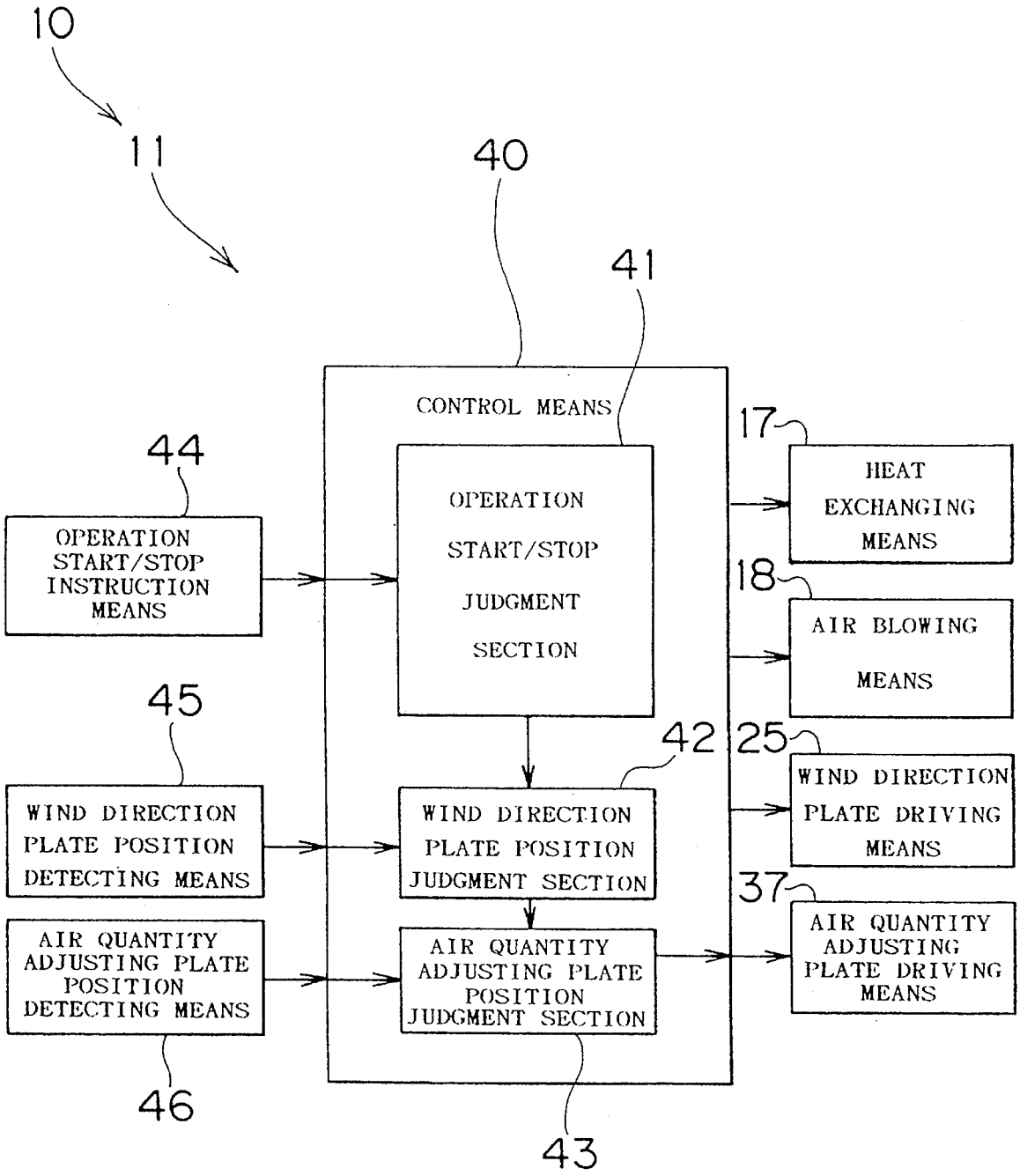
FIG. 5 is a block diagram showing the structure of the aforementioned embodiment.

The aforementioned air conditioner 10 is controlled by a control means 40 as shown in FIG. 5 so that the air quantity adjusting plate 30 is rotated in synchronism with the wind direction plates 20.

The control means 40 has an operation start/stop judgment section 41 for making judgment as to starting/stopping of the operation of the air conditioner 10, a wind direction plate position judgment section 42 for judging the rotational position of the wind direction plates 20, and an air quantity adjusting plate position judgment section 43 for judging whether the air quantity adjusting plate 30 is in the initial position A or in the open position B. The control means 40 is formed to give an instruction to heat exchanging means 17 such as heat exchangers, or the like, air blowing means 18 such as a cross flow fan, or the like, wind direction plate driving means 25 such as a wind direction plate driving motor, or the like, and air quantity adjusting plate driving means 37.

Incidentally, any suitable electric motor, solenoid valve, or the like, can be employed as the air quantity adjusting plate driving means 37 so that the means 37 is started/stopped and rotated forward/backward in a range of a predetermined rotation angle in accordance with the result of the judgment in the air quantity adjusting plate position judgment section 43.

The operation start/stop judgment section 41 is designed so that a signal issued from an operation start/stop instruction means 44 such as a remote controller, or the like, is judged as an operation start signal or an operation stop signal.

The wind direction plate position judgment section 42 is designed so that the rotational position of the wind direction plates 20 is detected by a wind direction plate position detecting means 45 such as an angle sensor, or the like, to thereby judge whether the wind direction plates 20 are in the vertically downward ventilation position or not.

The air quantity adjusting plate position judgment section 43 is designed so that the rotational position of the air quantity adjusting plate 30 is detected by an air quantity adjusting plate position detecting means 46 such as an angle sensor, or the like, to thereby judge whether the air quantity adjusting plate 30 is in the initial position A or in the open position B.

Figure 6:
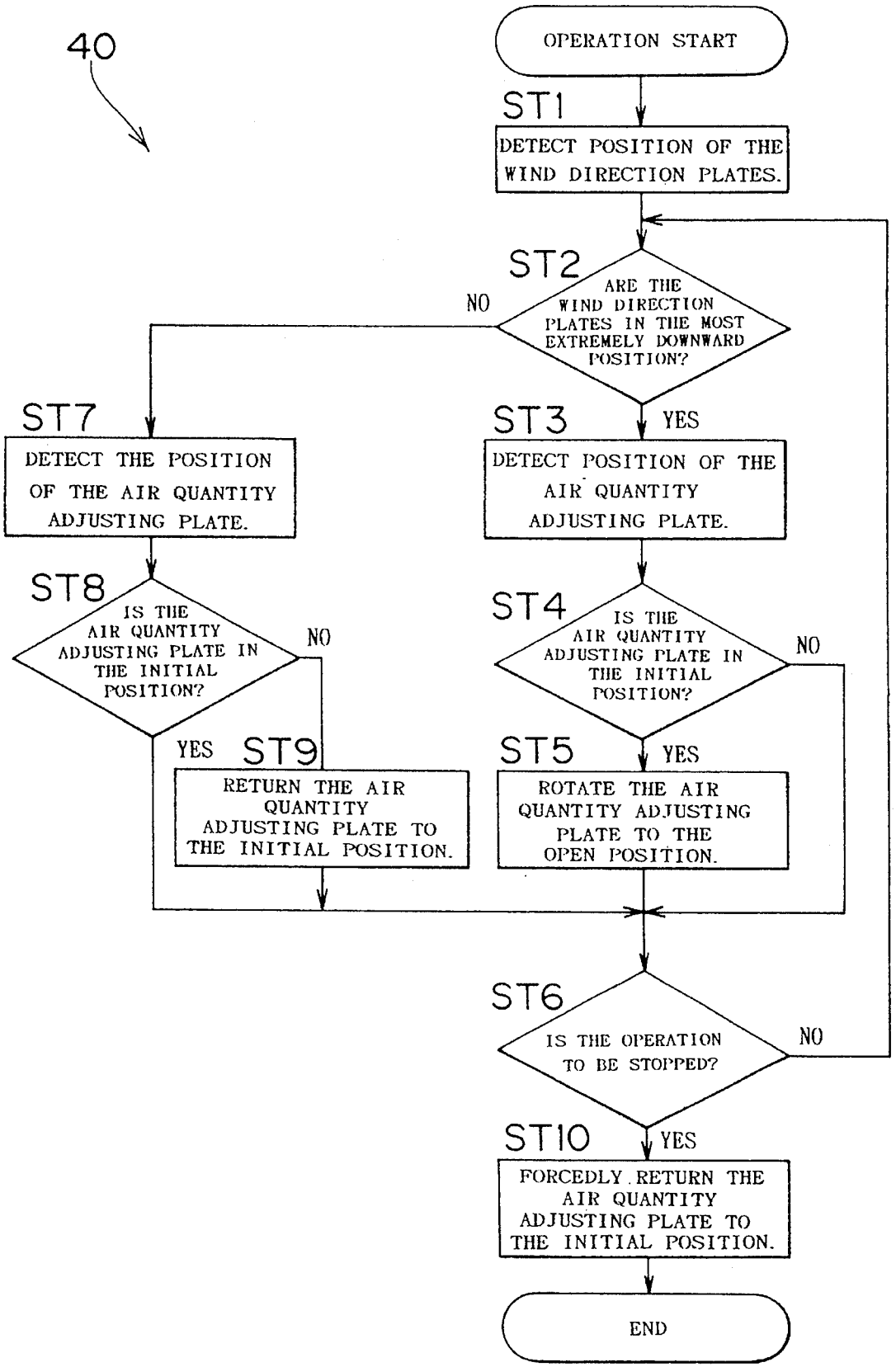
FIG. 6 is a flow chart showing a flow of controlling in the aforementioned embodiment.

Further, the air quantity adjusting plate 30 is controlled by the operation of the control means 40 as shown in FIG. 6.

That is, when the operation of the air conditioner is started, the position (rotational position) of the wind direction plates is detected in step ST1 and then a judgment is made in step ST2 as to whether the wind direction plates are in the most extremely downward position or not, that is, in the vertically downward ventilation position or not. When the step ST2 makes a decision that the wind direction plates are in the most extremely downward position (YES), the position (rotational position) of the air quantity adjusting plate is detected in step ST3 and then a judgment is made in step ST4 as to whether the air quantity adjusting plate is in the initial position or not. When a decision is made that the air quantity adjusting plate is in the initial position (YES), the air quantity adjusting plate is rotated to the open position in step ST5 and then the situation of the routine goes to step ST6. When the step ST4 contrariwise makes a decision that the air quantity adjusting plate is not in the initial position (NO), the step ST5 is omitted so that the situation of the routine goes to the step ST6 directly.

When the step ST6 makes a decision that the operation of the air conditioner is not to be stopped (NO), the situation of the routine goes back to the step ST2 again.

When the step ST2 contrariwise makes a decision that the wind direction plates are not in the most extremely downward position, that is, not in the vertically downward ventilation position (NO), the position (rotational position) of the air quantity adjusting plate is detected in step ST7 and then a judgment is made in step ST8 as to whether the air quantity adjusting plate is in the initial position or not. When a decision is made that the air quantity adjusting plate is not in the initial position (NO), the air quantity adjusting plate is returned to the initial position in step ST9 and then the situation of the routine goes to the step ST6. When the step ST8 contrariwise makes a decision that the air quantity adjusting plate is in the initial position (YES), the step ST9 is omitted so that the situation of the routine goes to the step ST6 directly.

When the step ST6 then makes a decision that the operation of the air conditioner is to be stopped (YES), the air quantity adjusting plate is forcedly returned to the initial position in step ST10 and then the controlling of the air quantity adjusting plate is terminated.

According to the aforementioned embodiment, because the air quantity adjusting plate 30 for changing the area of the opening of the air outlet 15 is provided at an end of the opening of the air outlet 15 in the air conditioner 10, a sufficient air quantity can be maintained by the air quantity adjusting plate 30 changing the area of the opening of the air outlet 15 even in the case where the wind direction plates 20 are rotated to the vertically downward ventilation position so as to reduce the substantial area of the opening of the air outlet 15 for the purpose of downward ventilation.

Further, because the first face 31 and the second face 32 constituting the air quantity adjusting plate 30 are contiguous to the inner wall of the blowout passage 19 and to the decoration cover 26 of the housing 12, respectively, the air quantity adjusting plate 30 is inconspicuous from the outside when it is in the initial position A, that is, when there is no necessity of use of it. Accordingly, the external appearance of the interior equipment 11 constituting the air conditioner 10 can be made good.

Further, because the air quantity adjusting plate 30 is formed to be substantially V-shaped in section, the continuity thereof to the wall surface of the blowout passage 19 and the continuity thereof to the decoration cover 26 are obtained simultaneously.

Further, because the air quantity adjusting plate 30 is rotatable around the pivot 35, the area of the opening of the air outlet 15 can be changed easily by a simple operation of rotating the air quantity adjusting plate 30 to the open position B.

Further, because the pivot 35 is disposed in parallel with the wind direction plate pivots 21, the air quantity adjusting plate 30 can be rotated in the same direction as the direction of the rotation of the wind direction plates 20. Accordingly, the air quantity adjusting plate 30 is rotated in the same direction as the direction of the rotation of the wind direction plates 20 rotated to reduce the area of the opening of the air outlet 15, by which the reduced area of the opening of the air outlet 15 can be recovered easily, that is, the area of the opening of the air outlet 15 can be increased.

Particularly, the pivot 35 does not project into the blowout passage 19 because it is provided in the rear side of the boundary portion 36 between the inner wall of the blowout passage 19 and the first face 31. Accordingly, the pivot 35 does not constitute air resistance against ventilation of thermoregulated air in the blowout passage 19, by which the air conditioner 10 performs room air-conditioning efficiently.

Further, because the air quantity adjusting plate 30 is rotatable in a range of from the initial position A to the open position B, the air quantity adjusting plate 30 may be rotated only in one direction as a rotating operation from the initial position A to the open position B or as a returning operation from the open position B to the initial position A. Accordingly, the control means 40 may control the air quantity adjusting plate driving means 37 so that the forward/backward rotation of the air quantity adjusting plate driving means 37 is repeated in a range of a predetermined rotation angle.

Further, because the heat insulating material 34 is stuck to the rear surface of the air quantity adjusting plate 30, not only dew condensation, or the like, can be prevented from occurring in the front surface of the air quantity adjusting plate 30 but also external appearance thereof can be made good when cooled air is blown out. Particularly, because the heat insulating material 34 is stuck to the rear surface of the first face 31 most greatly influenced by cooled air, the effect of preventing dew condensation can be made high.

Further, because the air quantity adjusting plate 30 is sectionally shaped so that the sectional length L2 of the second face 32 is set to be shorter than the sectional length L1 of the first face 31, the end portion of the second face 32 and the decoration cover 26 do not interfere with each other even in the case where the air quantity adjusting plate 30 is rotated to the open position B. Accordingly, the range of the rotation thereof can be increased.

Further, because the step portion 27 directed toward the inside of the housing 12 is formed at an end portion of the decoration cover 26, the end portion of the second face 32 and the decoration cover 26 do not interfere with each other in the same manner as described above even in the case where the air quantity adjusting plate 30 is rotated to the open position B. Accordingly, the range of the rotation of the air quantity adjusting plate 30 can be also increased.

Further, because the chamfered portion 33 is provided between the first and second faces 31 and 32 in the air quantity adjusting plate 30, the short side size of the substantial area of the opening can be increased and blown air resistance can be reduced when the air quantity adjusting plate 30 is rotated to the open position B.

Further, because the air quantity adjusting plate 30 is rotated by the air quantity adjusting plate driving means 37, the rotating operation thereof can be automated. Specifically, because any suitable electric motor or solenoid valve is employed as the air quantity adjusting plate driving means 37, cost for production of the air conditioner 10 can be reduced even in the case where the air quantity adjusting plate 30 is provided newly.

Further, because the air quantity adjusting plate driving means 37 is controlled by the control means 40, the air quantity adjusting plate 30 can be rotated automatically in accordance with a predetermined set condition.

Further, because the wind direction plates 20 and the air quantity adjusting plate 30 are synchronously controlled by the control means 40, the air quantity adjusting plate 30 can be rotated to the open position B in synchronism with the wind direction plates 20 when the wind direction plates 20 are rotated to the downward ventilation position.

Further, because the air quantity adjusting plate 30 is rotated to the open position B automatically to increase the area of the opening of the air outlet 15 when the area of the opening is reduced, the air conditioner 10 can blow out thermoregulated air into the room with a continuously constant air quantity regardless of the direction of blowing of air. Accordingly, the air conditioner 10 can perform room air-conditioning extremely efficiently compared with the conventional air conditioner.

Figure 7:
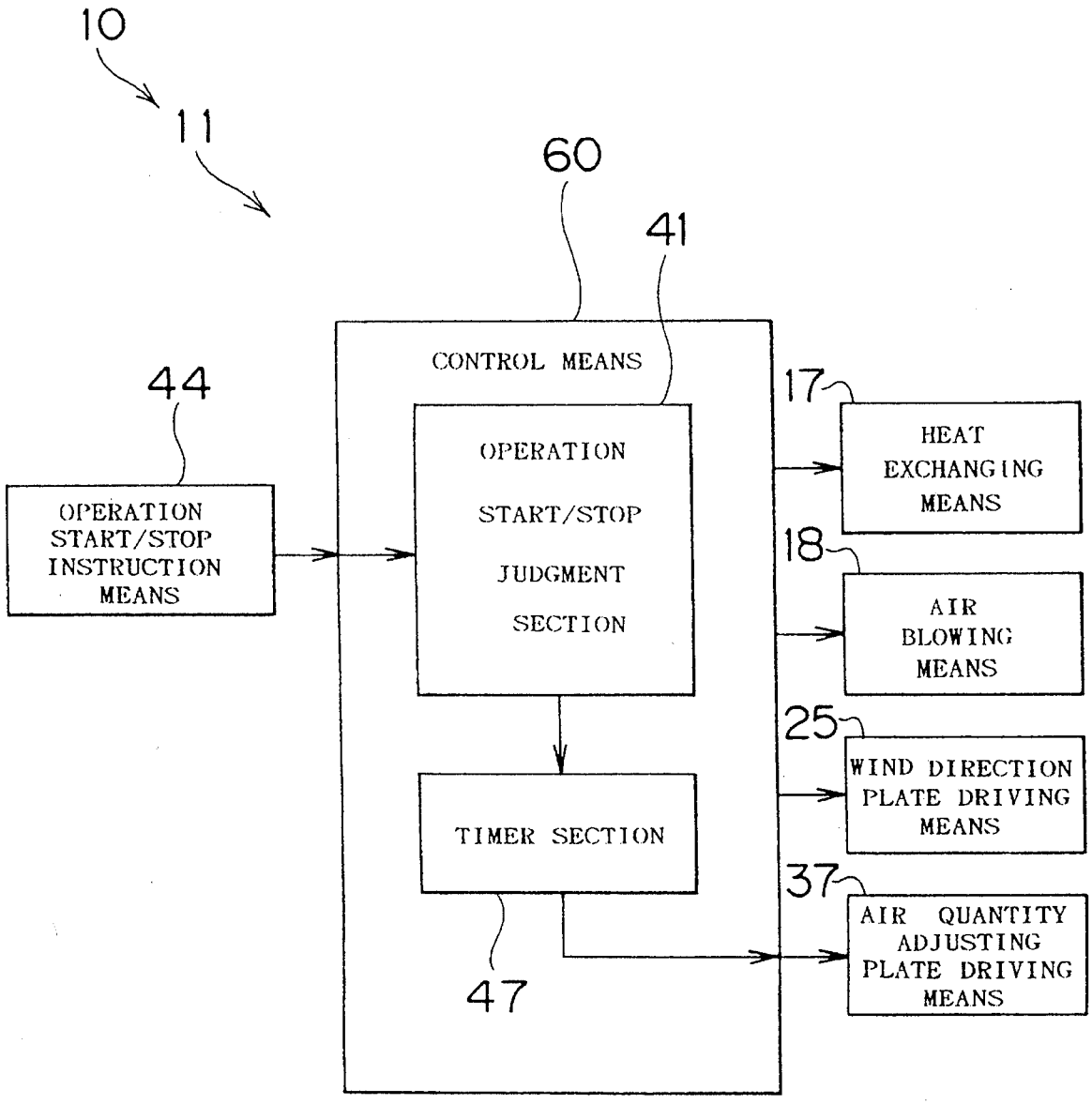
FIG. 7 is a block diagram showing the structure of a third embodiment of the present invention.
Figure 8:
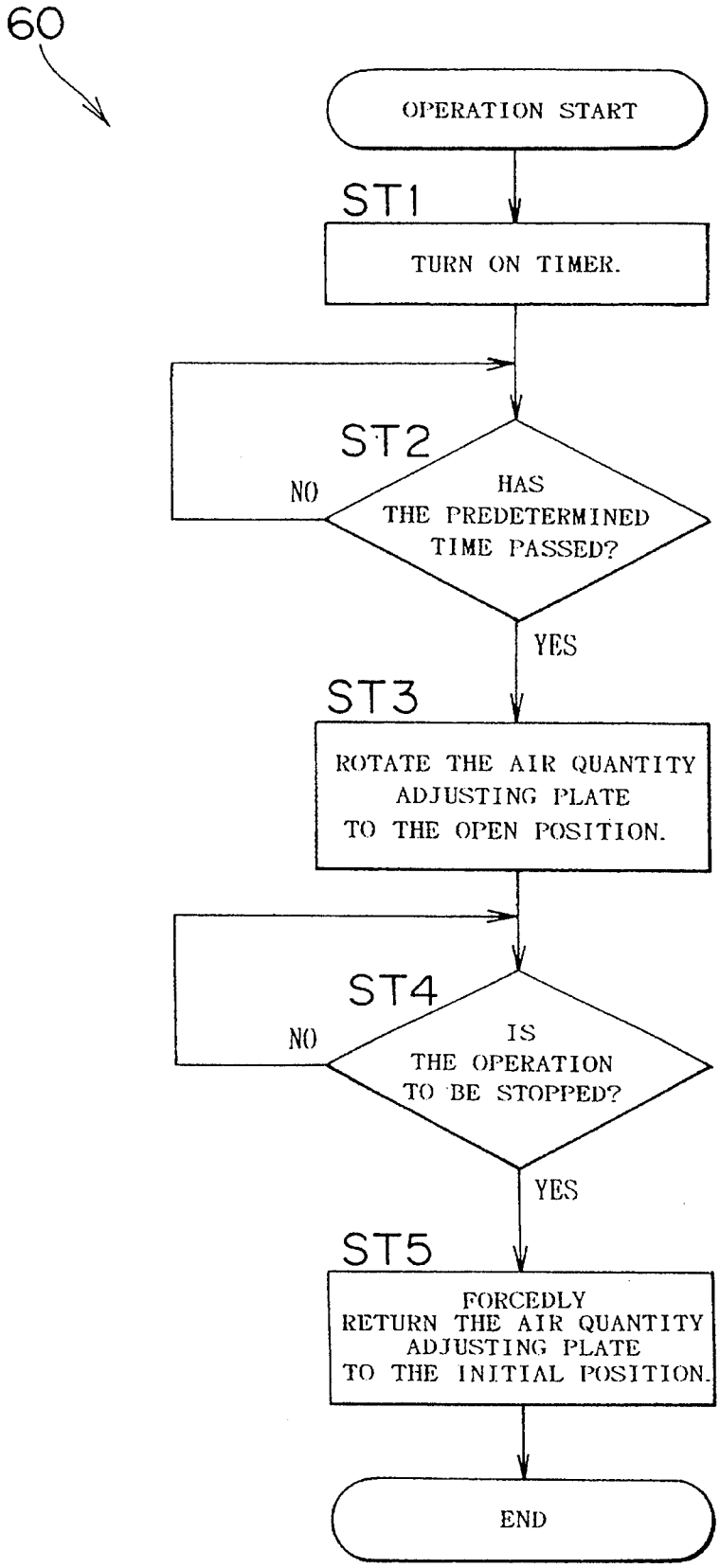
FIG. 8 is a flow chart showing a flow of controlling in the aforementioned embodiment.

FIGS. 7 and 8 show a third embodiment of the present invention. In the embodiment which will be described below, the mechanical structure of the interior equipment 11 constituting the air conditioner 10 is the same as that of the interior equipment 11 described above in the second embodiment. Accordingly, illustration and description thereof will be omitted but illustration and description will be made upon a control means 60 which is different from the control means described above in the second embodiment.

Incidentally, in the embodiment which will be described below, the same constituent element as the constituent element of the control means described above in the second embodiment is identified by an identical reference numeral in the drawing for simplification or omission of description.

As shown in FIG. 7, the control means 60 has an operation start/stop judgment section 41, and a timer section 47 for measuring a predetermined time after the start of the operation of the air conditioner 10.

The timer section 47 is designed to give a start instruction to the air quantity adjusting plate driving means 37 when a predetermined time, for example, five minutes, has passed after the start of the operation of the air conditioner 10.

The aforementioned control means 60 operates as shown in FIG. 8.

That is, when the operation of the air conditioner is started, the timer is switched on in step ST1 and then a judgment is made in step ST2 as to whether the predetermined time has passed or not. When the step ST2 makes a decision that the predetermined time has not passed (NO), the control means 60 waits for the passage of the predetermined time. When the step ST2 contrariwise makes a decision that the predetermined time has passed (YES), the air quantity adjusting plate is rotated to the open position in step ST3 and then the situation of the routine goes to step ST4. When the step ST4 makes a decision that the operation of the air conditioner is not to be stopped (NO), the control means 60 waits for the issuing of an operation stop instruction. When the step ST4 contrariwise makes a decision that the operation of the air conditioner is to be stopped (YES), the air quantity adjusting plate is forcedly returned to the initial position in step ST5 and then the controlling of the air quantity adjusting plate is terminated.

According to the aforementioned embodiment, the mechanical structure of the interior equipment 11 constituting the air conditioner 10 is the same as that of the interior equipment described previously in the second embodiment, so that the same mechanical effect as that of the interior equipment described previously in the second embodiment is obtained.

On the other hand, according to this embodiment, when a predetermined time has passed after the start of the operation of the air conditioner 10, the air quantity adjusting plate driving means 37 is started by the control means 60 to thereby perform controlling so that the air quantity adjusting plate is rotated to the open position.

Accordingly, for example, as long as a time required for making the temperature of the heat exchangers reach a temperature suitable for thermoregulating room air to a desired temperature is inputted to the timer section 47 in advance, the air thermoregulated to the desired temperature is blown out through the air outlet with a sufficient air quantity after the passage of the predetermined time. As a result, the air conditioner 10 performs room air-conditioning efficiently.

Figure 9:
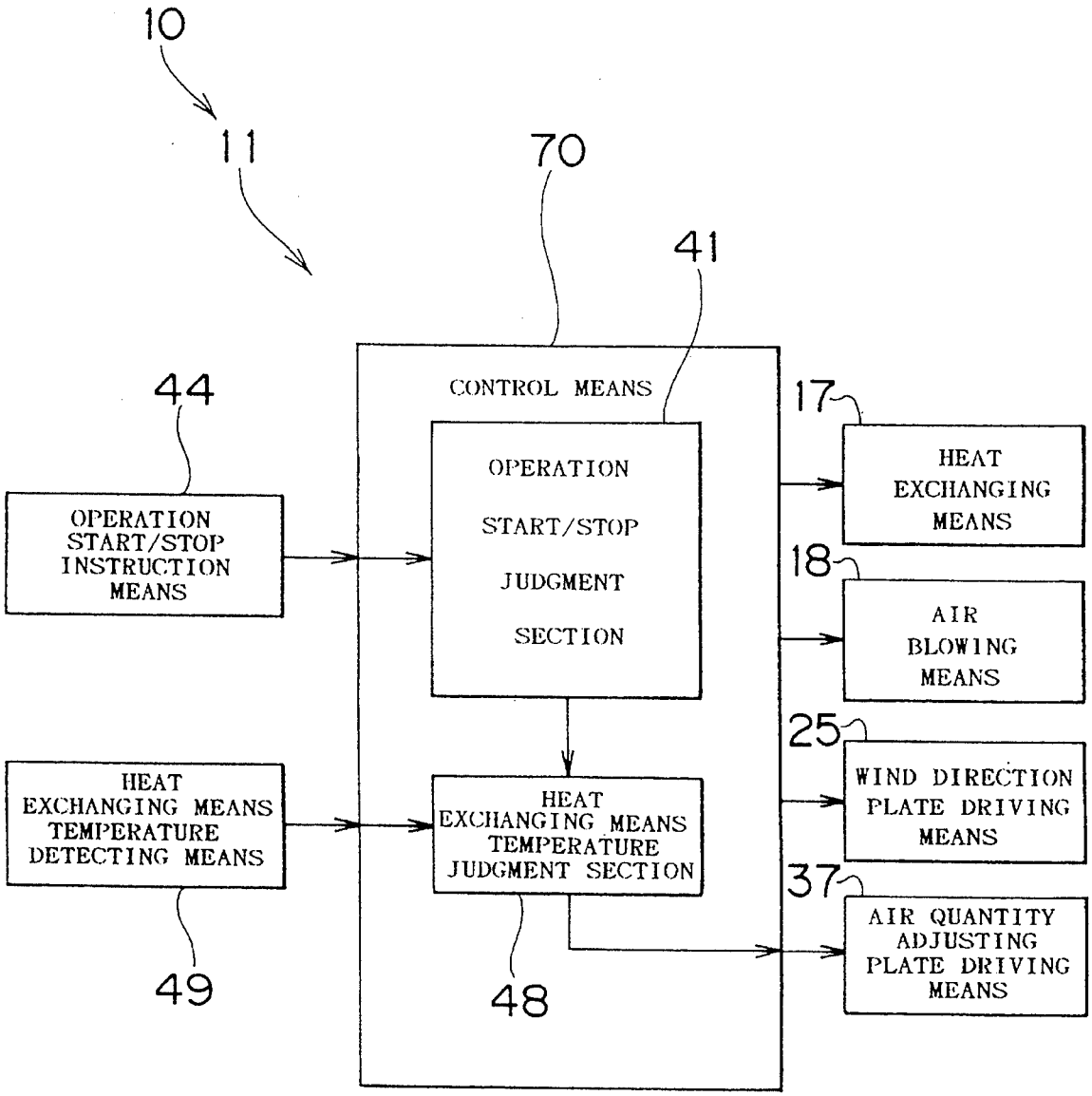
FIG. 9 is a block diagram showing the structure of a fourth embodiment of the present invention.
Figure 10:
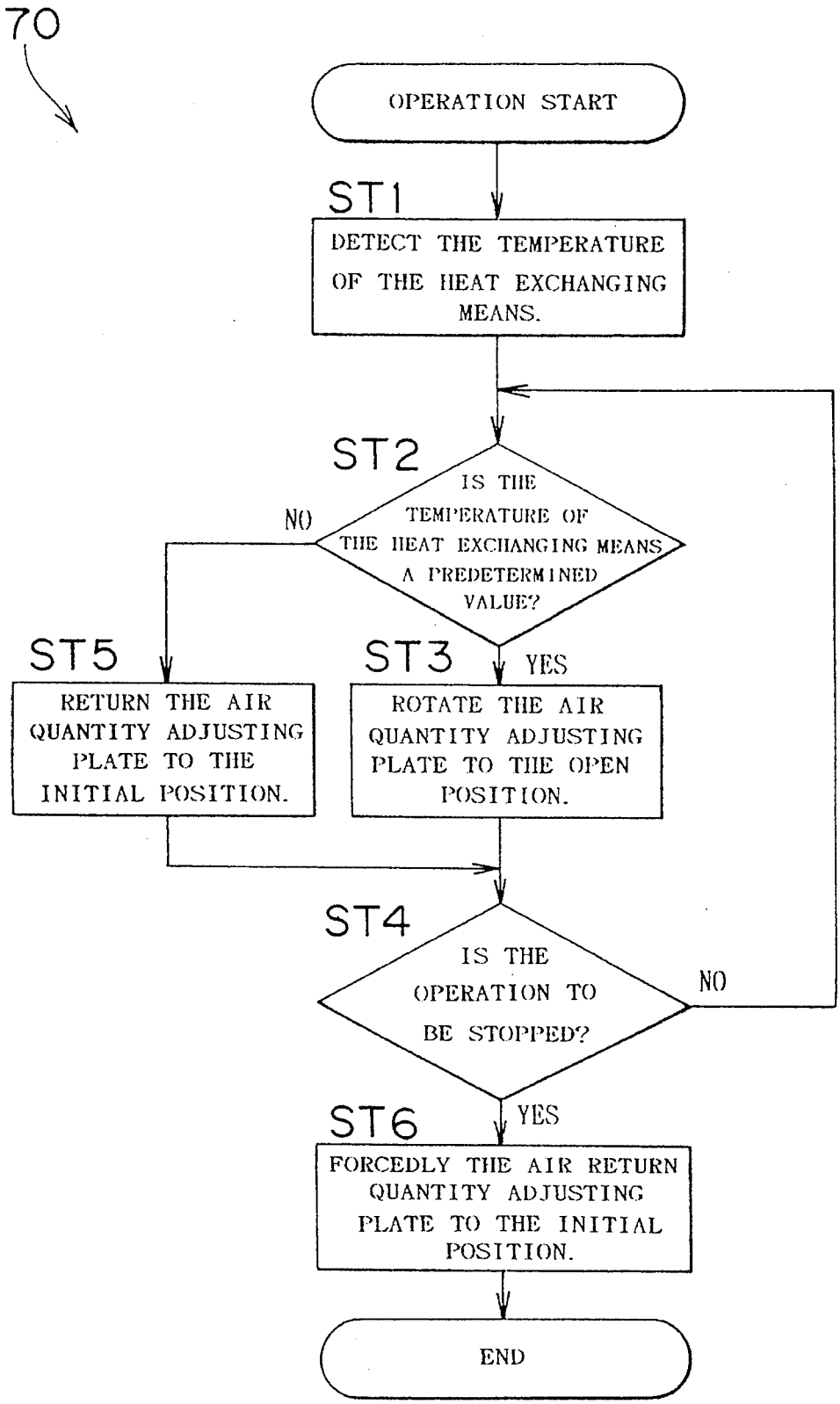
FIG. 10 is a flow chart showing a flow of controlling in the aforementioned embodiment.

FIGS. 9 and 10 show a fourth embodiment of the present invention. In the embodiment which will be described below, the mechanical structure of the interior equipment 11 constituting the air conditioner 10 is the same as that of the interior equipment 11 described previously in the second embodiment. Accordingly, illustration and description thereof will be omitted but illustration and description will be made upon a control means 70 which is different from the control means described previously in the second embodiment.

Incidentally, in the embodiment which will be described below, the same constituent element as the constituent element of the control means described above in the second embodiment is identified by an identical reference numeral for simplification or omission of description.

As shown in FIG. 9, the control means 70 has an operation start/stop judgment section 41, and a heat exchanging means temperature judgment section 48 for judging whether the temperature of heat exchanging means such as heat exchangers or the like has reached a predetermined temperature or not.

The heat exchanging means temperature judgment section 48 is designed to judge whether the temperature of the heat exchanging means 17 detected by a heat exchanging means temperature detecting means 49, such as a temperature sensor, or the like, after the start of the operation of the air conditioner 10 has reached a predetermined temperature or not.

The aforementioned control means 70 operates as shown in FIG. 10.

That is, when the operation of the air conditioner is started, the temperature of the heat exchanging means is detected in step ST1 and then a judgment is made in step ST2 as to whether the temperature of the heat exchanging means is a predetermined temperature or not. When the step ST2 makes a decision that the temperature of the heat exchanging means is the predetermined temperature (YES), the air quantity adjusting plate is rotated to the open position in step ST3 and then the situation of the routine goes to step ST4. On the other hand, when the step ST2 contrariwise makes a decision that the temperature of the heat exchanging means is not the predetermined temperature (NO), the air quantity adjusting plate is returned to the initial position in step ST5 and then the situation of the routine goes to the step ST4.

When the step ST4 makes a decision that the operation of the air conditioner is not to be stopped (NO), the situation of the routine goes back to the step ST2 to judge again whether the temperature of the heat exchanging means is the predetermined temperature or not. On the other hand, when the step ST4 contrariwise makes a decision that the operation of the air conditioner is to be stopped (YES), the air quantity adjusting plate is forcedly returned to the initial position in step ST6 and then the controlling of the air quantity adjusting plate is terminated.

According to the aforementioned embodiment, the mechanical structure of the interior equipment 11 constituting the air conditioner 10 is the same as that of the interior equipment described previously in the second embodiment, so that the same mechanical effect as that of the interior equipment described previously in the second embodiment is obtained.

On the other hand, according to this embodiment, the air conditioner 10 is designed so that the air quantity adjusting plate is controlled by the control means 70 so that it is rotated to the open position after the temperature of the heat exchanging means has reached the predetermined temperature. Accordingly, after the temperature of the heat exchangers has reached a temperature suitable for thermoregulating room air to a desired temperature, the air thermoregulated to the desired temperature is blown out through the air outlet with a sufficient air quantity. As a result, the air conditioner 10 performs room air-conditioning efficiently.

Figure 11:
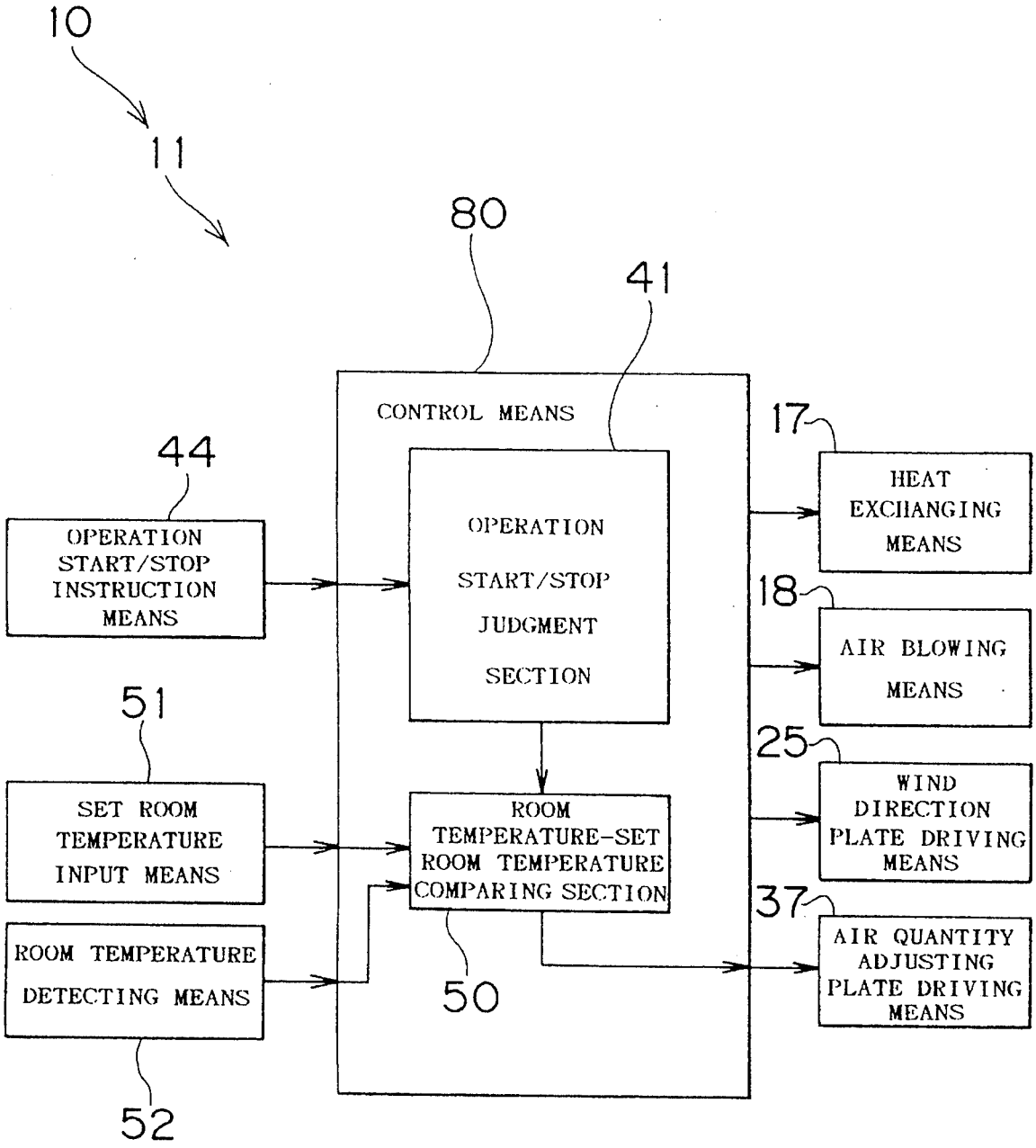
FIG. 11 is a block diagram showing the structure of a fourth embodiment of the present invention.
Figure 12:
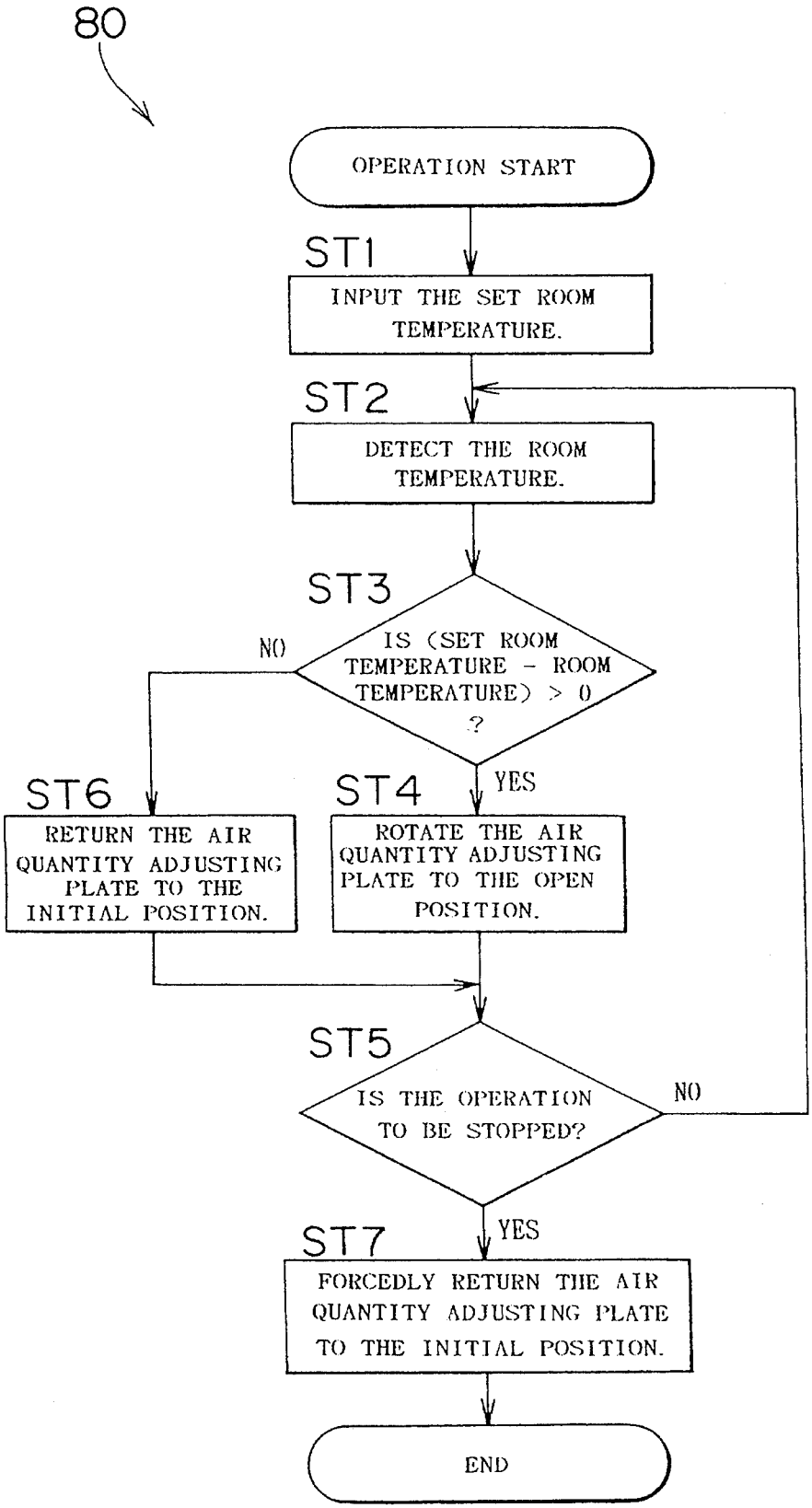
FIG. 12 is a flow chart showing a flow of controlling in the aforementioned embodiment.
Figure 13:
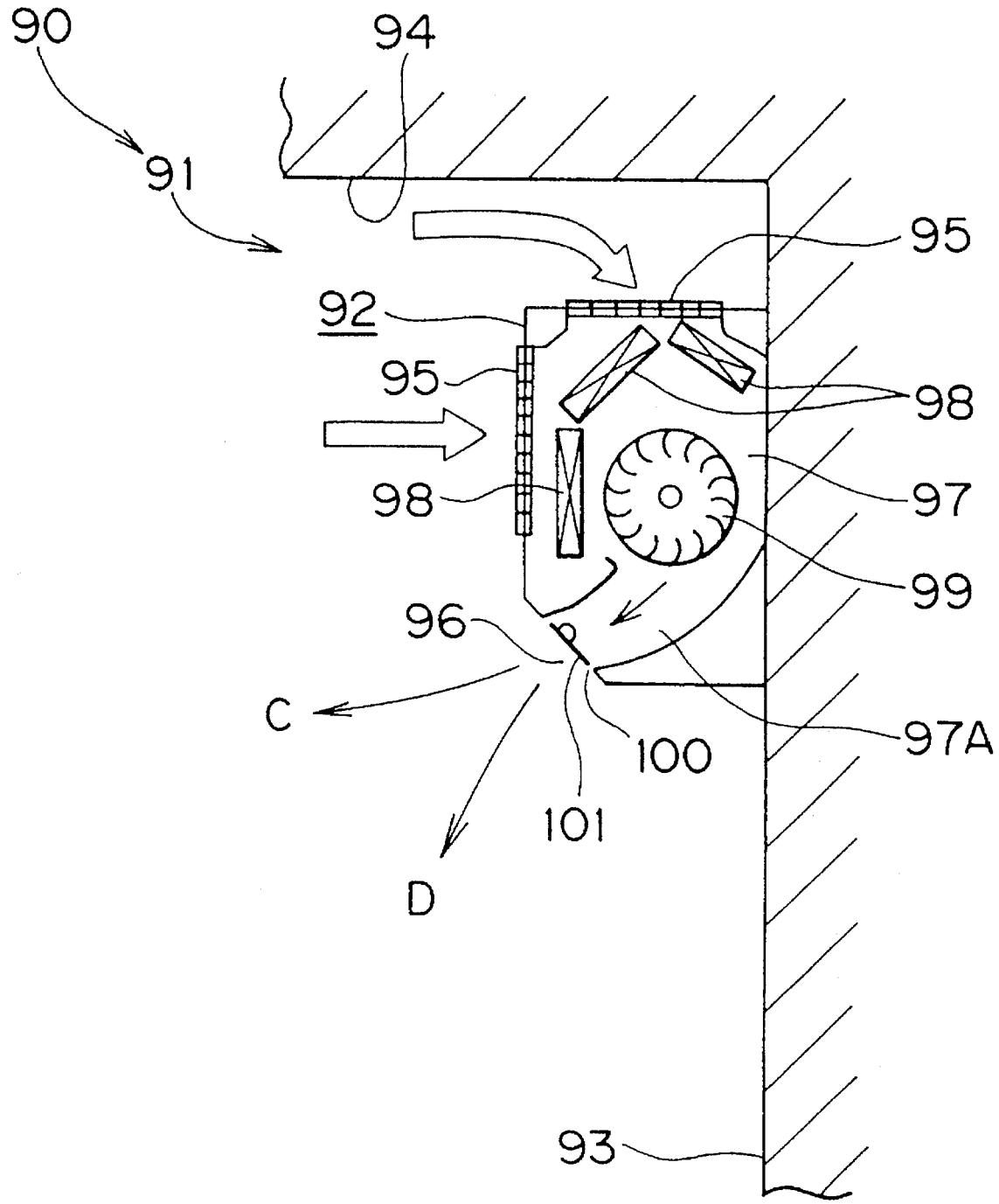
FIG. 13 PRIOR ART
FIG. 13 is a typical sectional view showing a housing of an interior equipment constituting a conventional air conditioner.
Figure 14:
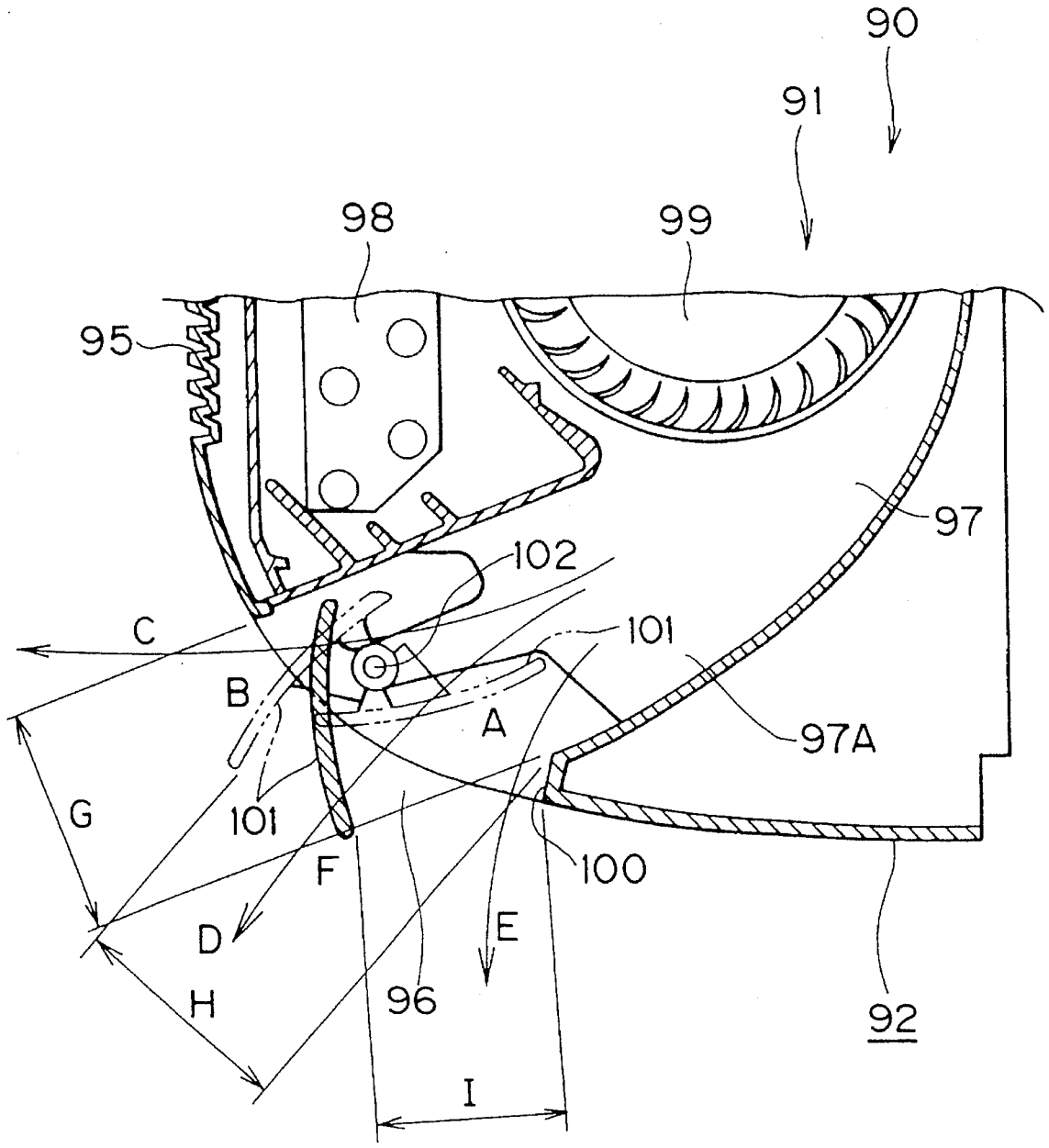
FIG. 14 PRIOR ART
FIG. 14 is an important part sectional view showing the operation of a wind direction plate.

FIGS. 11 and 12 show a fifth embodiment of the present invention. In the embodiment which will be described below, the mechanical structure of the interior equipment 11 constituting the air conditioner 10 is the same as that of the interior equipment 11 described previously in the second embodiment. Accordingly, illustration and description thereof will be omitted but illustration and description will be made upon a control means 80 which is different from the control means described previously in the second embodiment.

Incidentally, in the embodiment which will be described below, the same constituent element as the constituent element of the control means described previously in the second embodiment is identified by an identical reference numeral for simplification or omission of description.

As shown in FIG. 11, the control means 80 has an operation start/stop judgment section 41, and a room temperature-set room temperature comparing section 50 for comparing a set room temperature and a real room temperature with each other.

The room temperature-set room temperature comparing section 50 compares the set room temperature given arbitrarily by a set room temperature input means 51 with the real room temperature detected by a room temperature detecting means 52 such as a temperature sensor, or the like, and judges whether the difference therebetween is in a predetermined range or not.

The aforementioned control means 80 operates as shown in FIG. 12 when the air conditioner 10 is in air-heating operation.

That is, when the operation of the air conditioner is started and then a set room temperature (for example, 20° C.) is inputted in step ST1, the room temperature (for example, 10° C.) is detected in step ST2 and then a judgment is made in step ST3 as to whether the relation: (set room temperature—room temperature)>0 (20° C.–10° C.>0) is valid or not. When the step ST3 makes a decision that the relation: (set room temperature—room temperature)>0 is valid (YES), the air quantity adjusting plate is rotated to the open position in step ST4 and then the situation of the routine goes to step ST5. On the other hand, when the step ST3 contrariwise makes a decision that the relation: (set room temperature—room temperature)>0 is invalid (NO), the air quantity adjusting plate is returned to the initial position in step ST6 and then the situation of the routine goes to the step ST5.

When the step ST5 makes a decision that the operation of the air conditioner is not to be stopped (NO), the situation of the routine goes back to the step ST2 for detecting the room temperature again and then the situation of the routine goes to the step ST3. On the other hand, when the step ST5 contrariwise makes a decision that the operation of the air conditioner is to be stopped (YES), the air quantity adjusting plate is forcedly returned to the initial position in step ST7 and then the controlling of the air quantity adjusting plate is terminated.

According to the aforementioned embodiment, the mechanical structure of the interior equipment 11 constituting the air conditioner 10 is the same as that of the interior equipment described previously in the second embodiment, so that the same mechanical effect as that of the interior equipment described previously in the second embodiment is obtained.

On the other hand, according to this embodiment, the air conditioner 10 in the air-heating operation is designed so that the air quantity adjusting plate is controlled by the control means 80 so that it is rotated to the open position when the difference of the real room temperature from the set room temperature is larger than zero and it is returned to the initial position when the difference of the real room temperature from the set room temperature is not larger than zero.

Accordingly, the air conditioner 10 rotates the air quantity adjusting plate automatically to make the real room temperature coincident with the set room temperature to thereby perform room air-conditioning so that a desired room temperature is kept.

Incidentally, the present invention is not limited to the aforementioned embodiments and changes, modifications, and so on, may be included in the present invention as long as the present invention can be carried out.

Although controlling methods for rotating the air quantity adjusting plate to the open position have been illustrated individually in the aforementioned embodiments, the air conditioner according to the present invention, for example, may include all these controlling methods to perform controlling suitably selectively.

Further, the present invention can be applied not only to the case where the interior equipment constituting the air conditioner is mounted on a wall surface in the interior of a room but also to the case where the interior equipment is set up on the floor in the interior of a room or embedded in the ceiling in the interior of a room.

Further, the present invention can be applied not only to an air conditioner of the type in which an interior equipment and an exterior equipment are set up separately in the interior and exterior of a building but also to a so-called integral type air conditioner in which the function of an interior equipment and the function of an exterior equipment are put into one and the same housing so that the housing is mounted on a window sash.

In addition, any materials, shapes, sizes, forms, numbers, arrangement positions, and so on, of the respective members shown in the aforementioned embodiments are selected without limitation as long as the present invention can be achieved.

According to the present invention, as described above, since lowering of the air quantity in the case where thermoregulated air is blown out in a specific direction is prevented by changing the area of the opening of the air outlet widely, an air conditioner with high air-conditioning efficiency can be obtained.

Further, according to the present invention, as described above, since the air quantity adjusting plate in the initial position can be provided inconspicuously, the external appearance of the housing can be made good.

Further, according to the present invention, as described above, the continuity to the inner wall of the opening of the air outlet and the continuity to the outer surface of the housing can obtained simultaneously.

Further, according to the present invention, as described above, the area of the opening of the air outlet can be changed by a simple operation of rotating the air quantity adjusting plate.

Further, according to the present invention, as described above, the reduced area of the opening of the air outlet by the wind direction plates can be widened easily by the air quantity adjusting plate.

Next, according to the present invention, as described above, since the end portion of the first face does not project into the opening of the air outlet regardless of the rotation of the air quantity adjusting plate, blown air resistance is not increased.

Further, according to the present invention, as described above, since the direction of the rotation of the air quantity adjusting plate is one direction, controlling of the air quantity adjusting plate driving means can be performed easily.

Further, according to the present invention, as described above, dew condensation, or the like, can be prevented from occurring in the front surface of the air quantity adjusting plate.

Particularly, according to the present invention, as described above, dew condensation as described above can be prevented securely.

Further, according to the present invention, as described above, the range of rotation of the air quantity adjusting plate can be widened.

Next, according to the present invention, as described above, not only the short side size of the substantial area of the opening can be increased but also blown air resistance can be reduced in the case where the air quantity adjusting plate is rotated to the open position.

Further, according to the present invention, as described above, the range of rotation of the air quantity adjusting plate can be widened more greatly.

Further, according to the present invention, as described above, the rotating operation of the air quantity adjusting plate can be automated.

Further, according to the present invention, as described above, production cost can be reduced by using general-use parts.

Further, according to the present invention, as described above, the air quantity adjusting plate can be rotated automatically in accordance with a predetermined condition.

Next, according to the present invention, as described above, the air quantity adjusting plate can be rotated in synchronism with the ventilation position of the wind direction plates.

In addition, according to the present invention, as described above, the air quantity adjusting plate can be rotated under various kinds of conditions.

What is claimed is:

1. An air conditioner to be installed in a room, comprising, a housing having upper and lower parts, an air inlet provided at the upper part of said housing, an air outlet provided at the lower part of said housing and having an opening with an inner wall, an air passage provided in said housing so as to connect said air inlet and said air outlet to each other, heat exchanging means and air blowing means disposed in said air passage;

a wind direction plate provided inside the opening of said air outlet in order to change a direction of air blown out of said air outlet, and an air quantity adjusting plate provided at an end of said opening of said air outlet in order to change an area of said opening of said air outlet, said air quantity adjusting plate having a first face contiguous to the inner wall of said opening of said air outlet and a second face contiguous to an outer surface of said housing.

2. An air conditioner according to claim 1, wherein said air quantity adjusting plate has a substantially V-shaped section in which said first and second faces are connected to each other.

3. An air conditioner according to claim 2, wherein said air quantity adjusting plate has a chamfered portion provided on a surface at a junction portion between said first and second faces.

4. An air conditioner according to claim 1, wherein said housing has a pivot, and said air quantity adjusting plate is made rotatable around the pivot provided in said housing.

5. An air conditioner according to claim 4, wherein said housing has a wind direction plate pivot which supports said wind direction plate pivotally and which is arranged parallel to said pivot for the air quantity adjusting plate.

6. An air conditioner according to claim 4, wherein said pivot is provided at a boundary portion between said inner wall of said opening of said air outlet and said first face.

7. An air conditioner according to claim 4, wherein said air quantity adjusting plate is made rotatable in a range from an initial position in which said first face is contiguous to said inner wall of said opening of said air outlet and in which the area of said opening of said air outlet is minimized to an open position in which the area of said opening of said air outlet is maximized.

8. An air conditioner according to any claim 7, wherein said air quantity adjusting plate is shaped so that an outer surface side end portion of said second face does not interfere with the outer surface of said housing when said air quantity adjusting plate is rotated to said open position.

9. An air conditioner according to claim 7, further comprising driving means for rotating said air quantity adjusting plate.

10. An air conditioner according to claim 9, wherein said driving means is constituted by an electric motor.

11. An air conditioner according to claim 9, further comprising control means for controlling said driving means.

12. An air conditioner according to claim 11, wherein said wind direction plate and said air quantity adjusting plate are controlled synchronously with each other by said control means.

13. An air conditioner according to claim 11, wherein said air quantity adjusting plate is rotated to said open position when said wind direction plate is turned downward most extremely.

14. An air conditioner according to claim 11, wherein said air quantity adjusting plate is rotated to said open position by the control means when a predetermined time has passed after starting of operation of said air conditioner.

15. An air conditioner according to claim 11, wherein said air quantity adjusting plate is rotated to said open position by the control means when a temperature of said heat exchanging means has reached a predetermined value after starting of operation of said air conditioner.

16. An air conditioner according to claim 11, wherein said air quantity adjusting plate is rotated to said open position by the control means when a room temperature has reached a predetermined value after starting of operation of said air conditioner.

17. An air conditioner according to claim 4, wherein a step portion is provided at an outer surface of said housing adjacent to said second face.

18. An air conditioner according to claim 1, wherein said air quantity adjusting plate has its rear surface onto which a heat insulating material is stuck.

19. An air conditioner according to claim 1, wherein said heat insulating material is stuck onto a rear surface of said first face.

* * * * *